US008959799B2

(12) United States Patent
Nishiwaki et al.

(10) Patent No.: US 8,959,799 B2
(45) Date of Patent: Feb. 24, 2015

(54) SHOE HAVING LACE FITTING STRUCTURE

(75) Inventors: Tsuyoshi Nishiwaki, Kobe (JP); Kenta Moriyasu, Kobe (JP); Seigo Nakaya, Kobe (JP); Moe Nagata, London (GB); Tomoko Ikezawa, Kobe (JP)

(73) Assignee: Asics Corporation, Hyogo (JP)

( * ) Notice: Subject to any disclaimer, the term of this patent is extended or adjusted under 35 U.S.C. 154(b) by 458 days.

(21) Appl. No.: 13/380,804

(22) PCT Filed: Jan. 29, 2010

(86) PCT No.: PCT/JP2010/051276

§ 371 (c)(1),
(2), (4) Date: Feb. 6, 2012

(87) PCT Pub. No.: WO2011/004619

PCT Pub. Date: Jan. 13, 2011

(65) Prior Publication Data

US 2012/0124866 A1 May 24, 2012

(30) Foreign Application Priority Data

Jul. 6, 2009 (WO) ..... PCT/JP2009/003130

(51) Int. Cl.
*A43C 11/00* (2006.01)
*A43B 7/14* (2006.01)
(Continued)

(52) U.S. Cl.
CPC ..... *A43B 7/1495* (2013.01); *A43C 11/008* (2013.01); *A43C 1/003* (2013.01); *A43B 23/027* (2013.01); *A43B 23/0295* (2013.01); *A43C 1/00* (2013.01)
USPC ..... 36/50.1

(58) Field of Classification Search
CPC ..... A43C 1/00; A43C 1/003; A43C 11/00; A43C 11/008; A43C 11/22
USPC ..... 36/50.1, 51, 50.5, 88, 91
See application file for complete search history.

(56) References Cited

U.S. PATENT DOCUMENTS 5,167,084 A * 12/1992 Flammier ..... 36/117.2
5,940,990 A * 8/1999 Barret ..... 36/55
(Continued)

FOREIGN PATENT DOCUMENTS

EP 0329392 A2 8/1989
JP 33-5240 4/1958
(Continued)

*Primary Examiner* — Jila M Mohandesi
(74) *Attorney, Agent, or Firm* — Mintz Levin Cohn Ferris Glovsky and Popeo, P.C.

(57) ABSTRACT

A shoe having a sole, an upper including a first opening and a second opening, and shoelace means, the upper including: a first side edge portion having a plurality of first eyelets; a second side edge portion arranged between the plurality of first eyelets and having one or more second eyelets which the shoelace means engages with; a movable portion for allowing the second eyelet to move with respect to the first eyelets both in a transverse direction across the second opening and a diagonal front-back direction that is perpendicular to the transverse direction and is extending along the instep; and a main portion covering a medial side surface, a lateral side surface, a toe, the instep and a back surface of a foot, the main portion including the first side edge portion and excluding the second side edge portion and the movable portion; the second eyelet is relatively displaced via the movable portion with respect to the main portion both in the transverse direction and the diagonal front-back direction in response to a change in a direction of a resultant force between a first tensile force and a second tensile force acting upon the second side edge portion from a V-shaped portion of the shoelace means engaging with the second eyelet while transitioning from a flat-footed position to a heel-raised position.

23 Claims, 41 Drawing Sheets

(51) Int. Cl.
*A43C 1/00* (2006.01)
*A43B 23/02* (2006.01)

(56) References Cited

U.S. PATENT DOCUMENTS

| | | | | |
|---|---|---|---|---|
| 5,966,841 | A * | 10/1999 | Barret | 36/50.1 |
| 6,367,169 | B1 * | 4/2002 | Barret | 36/51 |
| 7,159,340 | B2 * | 1/2007 | Borsoi | 36/50.1 |
| 7,823,298 | B2 * | 11/2010 | Nishiwaki et al. | 36/88 |
| 8,272,148 | B2 * | 9/2012 | Nishiwaki et al. | 36/88 |
| 8,375,602 | B2 * | 2/2013 | Takada et al. | 36/50.1 |
| 8,479,415 | B2 * | 7/2013 | Berger et al. | 36/101 |
| 2002/0069556 | A1 * | 6/2002 | Paxton | 36/51 |
| 2006/0162190 | A1 | 7/2006 | Nishiwaki et al. | |
| 2011/0296712 | A1 * | 12/2011 | Settele et al. | 36/113 |

FOREIGN PATENT DOCUMENTS

| | | | |
|---|---|---|---|
| JP | 59-128202 | | 8/1984 |
| JP | 04-044701 | A | 2/1992 |
| JP | 5-9843 | | 3/1993 |
| JP | 11-018803 | A | 1/1999 |
| JP | 2006-000258 | A | 1/2006 |
| WO | WO-2004093587 | A1 | 11/2004 |

* cited by examiner

X
53b
H2
5
58 57
4
2t
R
2M
22
2
21

X
50a
50
57
58
5
4
2t
R
2M
22
2
21

Test Example1

Test Example2

Test Example3

Test Example4

Reference exampple

Test Example11

Test Example12

Test Example13

Test Example14

Test Example15

Test Example16

Test Example17

Test Example11

Test Example12

Test Example17

Test Example16

FIG.38A
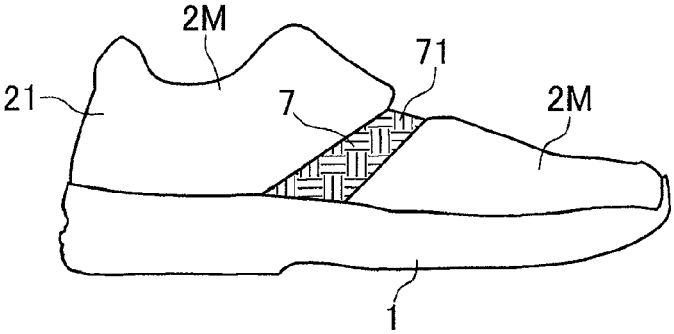
FIG.38D
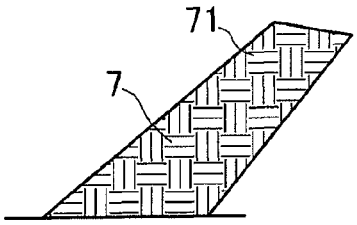
FIG.38B
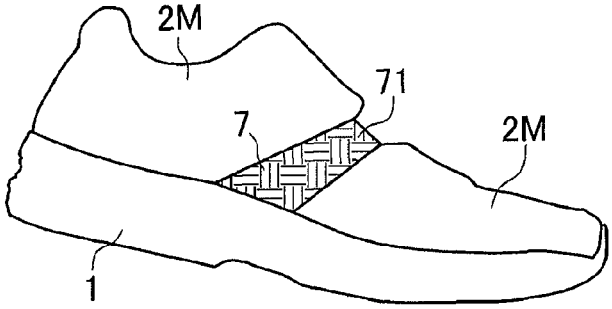
FIG.38E
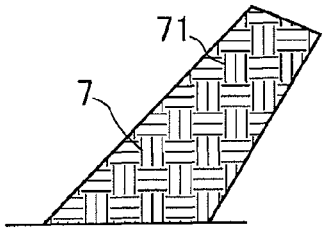
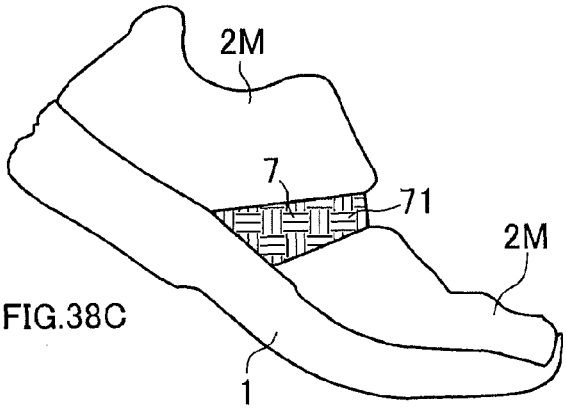
FIG.38C
FIG.38F
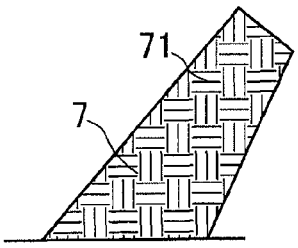

Test Example20

SHOE HAVING LACE FITTING STRUCTURE

CROSS-REFERENCE TO RELATED APPLICATIONS

This application is a U.S. national phase application under 37 U.S.C. §371 of Patent Cooperation Treaty Application No. PCT/JP2010/051276 filed on Jan. 29, 2010, which claims the priority benefit of Patent Cooperation Treaty Application No. PCT/JP2009/003130 filed on Jul. 6, 2009. The disclosure of each application listed in this paragraph is incorporated by reference herein in its entirety.

TECHNICAL FIELD

The present invention relates to a shoe having a lace fitting structure.

BACKGROUND ART

A shoelace fits an upper to the foot. The upper fitting the foot supports the foot.

However, during dorsal flexion of the MP joint, the foot shape changes, and therefore the foot circumference also changes. When shoes are worn over a long period of time, the foot circumference increases in many cases. In such a case, the foot inside a shoe will be compressed by the upper. Moreover, the shoe and the foot are likely to slip against each other during action.

[First Patent Document] Japanese Laid-Open Patent Publication No. 2006-258 (abstract)

[Second Patent Document] Japanese Laid-Open Patent Publication No. 11-18803 (abstract)

[Third Patent Document] Japanese Utility Model Publication for Opposition No. 33-5240 (FIG. 1)

[Fourth Patent Document] Japanese Utility Model Publication for Opposition No. 5-9843 (FIG. 3)

[Fifth Patent Document] EPO 329,392 A2 (abstract)

[Sixth Patent Document] Japanese Laid-Open Patent Publication No. 4-44701 (page 2, upper right col.)

[Seventh Patent Document] WO 2004/93587 A1, US 2006/0162190 A1 (abstract)

With a shoe of the first document, non-stretchable belts are fixed to the inner side of a stretchable upper, and the non-stretchable belts prevent the upper from stretching. In the shoe of the first document, an eyelet (loop) is provided at the tip of each non-stretchable belt, and therefore the eyelet will not move in the foot circumference direction in the shoe (while the shoe is worn).

The belts are continuous with each other in the front-back direction, with the tips of the belts attached to the stretchable member of the upper, and therefore the belts are prevented from being displaced freely.

A shoe of the second document has a size that is variable in the foot length direction. In order for the size to be variable in the foot length direction, this shoe includes, provided in the middle foot portion, a flexible fabric portion that is stretchable in the front-back direction of the upper. The flexible fabric portion does not stretch in the circumference direction. Therefore, since the eyelets provided in the flexible fabric portion do not move in the circumference direction, the foot will be compressed while wearing.

A shoe of the third document includes a wide stretchable piece on each side surface of the front foot portion. The wide stretchable piece may feel less compressive to the foot. However, the wide stretchable piece will not be able to support the side surface of the foot.

Since the ornamental eyelets are continuous with each other in the front-back direction, the eyelets will not move in the front-back direction. Therefore, the eyelets are prevented from moving freely.

The eyelet members of the fourth document are formed by a resin whose Shore hardness is 90 to 100. A resin whose Shore hardness is 90 to 100 will hardly stretch.

With a shoe of the fifth document, the rear foot portion is supported by a non-stretching supporting stirrup.

A shoe of the sixth document includes a pair of side panels (fastening bands) sandwiched between the inner skin and the outer skin of the upper. The side panels may be formed by a rubber sheet or a stretchable fabric, and each includes three eyelets. The aim of the shoe of the sixth document is that the side panel stretches and shrinks in the circumference direction to fasten depending on the magnitude of the foot circumference (circumferential length) of the person.

However, with the invention of the sixth document, the object is that the side panels connected together with shoelaces do not move on the upper skin in the front-back direction and reliably fasten a predetermined position of the instep of the foot, as stated on (page 1, right col. or) page 2, lower right col. of the publication, and the side panels are wide. Therefore, eyelets formed in the side panels are not at all intended to move in the front-back direction of the foot, and it is believed that they do not substantially move.

With the invention of the sixth document, the side panels formed by a rubber sheet or a stretchable fabric cover large areas of the side surfaces of the foot, and even cover areas posterior to the metatarsal bones. This will detract from the upper's function of holding or supporting the foot of the wearer.

With a shoe of the seventh document, eyelets formed by loops are provided in the vicinity of stretchable portions. Although it may appear from FIG. 5 of the seventh document that the loops are connected to the stretchable portions, the loops are provided on hard portions of the upper as can be seen from FIGS. 3 to 6 of the publication.

Therefore, the eyelets formed by loops shown in the publication cannot move in the circumference direction.

SUMMARY OF THE INVENTION

Technical Problem

It is an object of the present invention to provide a shoe capable of supporting the foot in a stable state, and decreasing the compression on the foot when the foot circumference changes and/or the slip between the shoe and the foot while in action.

Solution to Problem

A shoe of a first embodiment of the present invention is a shoe having a lace fitting structure, including: a sole for absorbing an impact of landing, an upper for wrapping around an instep, and a shoelace means for fitting the upper to the instep, wherein the upper includes a first opening from which a leg extends upward when the shoe is worn, and a second opening provided on a front side of the first opening, the two openings being continuous with each other in a front-back direction, the upper including: a first side edge portion provided along a side edge of the second opening and having a plurality of first eyelets which the shoelace means passes through and engages with; a second side edge portion arranged between the plurality of first eyelets and having one or more second eyelets which the shoelace means passes through and engages with; a movable portion for allowing the one or more second eyelets to move with respect to the first eyelets in a transverse direction across the second opening and a diagonal front-back direction that is perpendicular to the transverse direction and is extending along the instep; and a main portion covering a medial side surface, a lateral side surface, a toe, the instep and a back surface of a foot, the main portion including the first side edge portion and excluding the second side edge portion and the movable portion, wherein the second side edge portion including the one or more second eyelets is relatively displaced via the movable portion with respect to the main portion in the transverse direction and the diagonal front-back direction in response to a change in a direction of a resultant force between a first tensile force and a second tensile force acting upon the second side edge portion from a V-shaped portion of the shoelace means engaging with the one or more second eyelets while transitioning from a flat-footed position to a heel-raised position.

Advantageous Effect of the Invention

While transitioning from the flat-footed position to the heel-raised position, the shape of the foot changes due to the dorsal flexion of the MP joint, and the two tensile forces acting upon the shoelace change in response to the change in the shape of the foot, thus changing the resultant force between the tensile forces. As a result of the change in the direction of the resultant force, the second eyelet is displaced forward or backward in the diagonal front-back direction via the movable portion so that the direction of the resultant force becomes equal to or closer to the transverse direction. At the same time, the displacement of the second eyelet in the transverse direction prevents the tensile force acting upon the shoelace from increasing in a localized manner.

Thus, the upper fits to the foot without creating a substantial load on the second eyelet or first eyelets that are close to the second eyelet.

A shoe of a second embodiment of the present invention is a shoe having a lace fitting structure, including: a sole for absorbing an impact of landing, an upper for wrapping around an instep, and a shoelace means for fitting the upper to the instep, wherein the upper includes a first opening from which a leg extends upward when the shoe is worn, and a second opening provided on a front side of the first opening, the two openings being continuous with each other in a front-back direction, the upper including: a side edge portion provided along a side edge of the second opening and having a plurality of first eyelets which the shoelace means passes through and engages with; a side panel extending downward or diagonally downward from the second opening along a medial side surface or a lateral side surface of the foot so as to cover the medial side surface or the lateral side surface of the foot; and a main portion covering the medial side surface, the lateral side surface, a toe, the instep, and a back surface of the foot, the main portion including the side edge portion and excluding the side panel, the side panel including: a tip portion having a second eyelet which is provided at a tip of the side panel and which the shoelace means passes through and engages with, the tip portion being not attached to the main portion; a bottom portion attached to the main portion and/or the sole; and a middle portion arranged between the tip portion and the bottom portion, wherein: the tip portion of the side panel is capable of relatively moving with respect to the main portion in a diagonal front-back direction that is perpendicular to a transverse direction across the second opening and is extending along an upper surface of the instep; the side panel is arranged in a division portion obtained by dividing the side edge portion including the first eyelets formed therein into pieces, one on a front side and the other on a rear side; a width of the side panel in the diagonal front-back direction is smaller than that of the division portion; a sheet-like member forming the division portion has a flexural rigidity smaller than that of a member forming the main portion on a front side and a rear side of the division portion, or shrinks more easily than the member forming the main portion; and a flexural rigidity of a member forming the side panel is greater than that of the sheet-like member of the division portion.

Principle of Invention:

As the MP joint is dorsally-flexed while transitioning from the flat-footed position to the heel-raised position, an upper portion of the upper is bent in an "L"-like shape (angled shape) and is urged to shrink. Then, the rigidity of the upper prevents the bending of the upper, and the second opening is urged to expand, in response to the deformation of the upper, so that the width of the second opening in the transverse direction is increased as the second opening extends toward the first opening.

In the shoe of the second embodiment, the sheet-like member of the division portion is formed by a flexible member that has a small flexural rigidity or that shrinks easily, and does not prevent the bending of the upper. Therefore, it is possible to reduce the expansion of the width of the second opening in the transverse direction.

That is, the upper is less likely to expand, thus maintaining the state where the upper fits to the foot.

The shrinkable, flexible member is a so-called "stretchable member" in a sheet form, and may be a resin sheet or a rubber sheet that has rubber elasticity and that is capable of stretching and shrinking repeatedly.

On the other hand, the width of the side panel in the front-back direction is smaller than that of the division portion. Such a side panel with a small width is not restricted by the movement of the main portion of the upper on the front side and the rear side thereof or the deformation of the division portion, but can relatively freely deform when the foot is bent or follow the movement of the foot. Therefore, the second eyelet provided in the side panel can be relatively freely displaced with respect to the first eyelets. Therefore, the fastening force of the shoelace acts upon the upper without creating an unnecessary load on the foot.

Thus, this shoe is suitable for exercises involving running or walking over a long period of time.

Moreover, the rigid side panel stably supports the side surface of the foot in the flexible division portion.

As can be seen from the principle above, the second eyelet is relatively displaced in the front-back direction with respect to the first eyelets in the second embodiment, and therefore the second eyelet does not need to be relatively displaced in the circumference direction of the foot and the transverse direction.

The diagonal front-back direction which is perpendicular to the transverse direction and is extending along the upper surface of the instep, as used herein, refers to the direction which is perpendicular to the transverse direction across the second opening and in which eyelets are arranged in an array along the side edge of the second opening, and the direction is thus diagonal with respect to the bottom surface of the sole.

In the present invention, the movable portion may be formed by a non-stretchable side panel, instead of a stretchable portion having stretchability, in order for the second eyelet to be displaced via the movable portion with respect to the main portion both in the transverse direction and the diagonal front-back direction.

The meaning of the term "a shoelace means" as used in the present invention is not limited to cases where there is only a single shoelace, but includes cases where there are two or more shoelaces.

The term "eyelet" as used in the present invention means the hole itself which the shoelace passes through.

Therefore, an "eyelet" as used in the present invention includes a through hole formed by an eyelet member of a loop material, and also includes an eyelet that is formed by an eyelet member of a U-shaped metal part or a resin.

In the present invention, the stretchable portion capable of easily stretching and shrinking may be a sheet-like or band-like member with rubber elasticity whose material has a small Young's modulus, as well as a material that essentially is not stretchable but includes a plurality of circular, rectangular or square through holes arranged in a single row, two rows or in a staggered pattern so as to reproduce stretchability (a material that can be easily deformed). The stretchable portion may be formed by laying two stretchable sheet-like members on top of each other.

In the present invention, the main portion which is less stretchable than the stretchable portion may be obtained by restricting a stretchable mesh material with a non-stretchable tape material so that it becomes essentially non-stretching.

BRIEF DESCRIPTION OF THE DRAWINGS

FIGS. 38A, 38B and 38C are schematic side views showing the shoe of the embodiment as viewed from the medial side, moving from the flat-footed position to the heel-raised position, and FIGS. 38D, 38E and 38F are schematic side views showing how the division portion is deformed.

MODE FOR CARRYING OUT THE INVENTION

Figure 1:
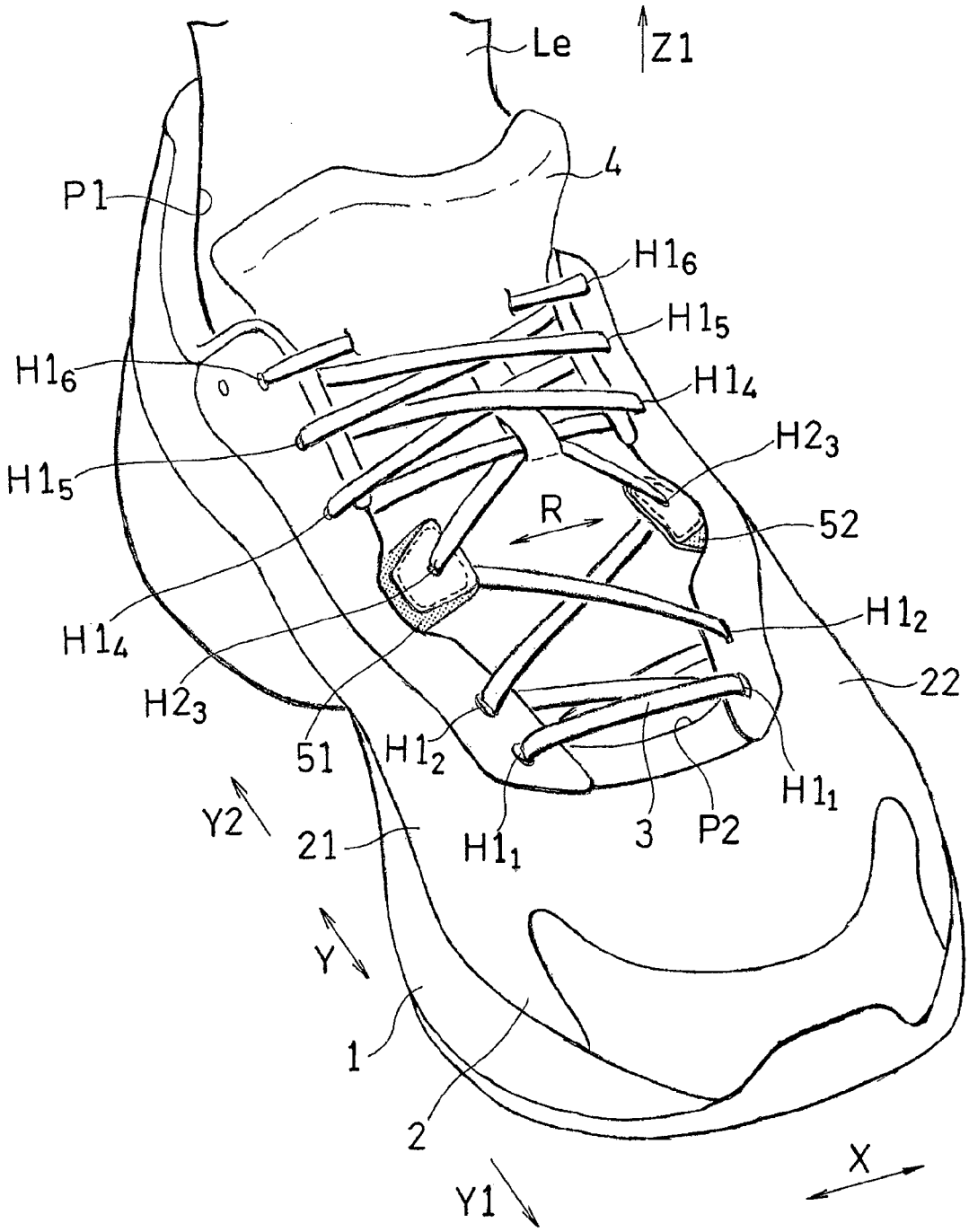
FIG. 1 is a schematic perspective view showing a shoe according to a first embodiment of the present invention.

In a first embodiment of the present invention, it is preferred that one of the first eyelets is adjacent to the second eyelet on a front side thereof in the diagonal front-back direction, and another one of the first eyelets is adjacent to the second eyelet on a rear side thereof in the diagonal front-back direction.

The reason for this is that if movable second eyelets are adjacent to each other in the diagonal front-back direction, the foot support in that area may become unstable.

In such a case, it is preferred that the plurality of first eyelets include first eyelets adjacent to each other in the diagonal front-back direction; a second distance between the second eyelet and a first eyelet on a front side thereof is greater than a first distance between first eyelets adjacent to each other in the diagonal front-back direction; and a third distance between the second eyelet and a first eyelet on a rear side thereof is greater than the first distance.

In this case, the second eyelet provided in the movable portion is arranged at a position apart from the first eyelet on the front side and the rear side, and the angle formed by the V-shaped shoelace is relatively large. Therefore, when the second eyelet moves closer to the first eyelet on the front side and/or the first eyelet on the rear side, the distance to an eyelet on the other side across the second opening changes substantially. Thus, the tensile force acting upon the V-shaped shoelace changes substantially.

In the first embodiment, it is preferred that the shoe further includes a side panel extending in a diagonally rearward and downward direction from the second opening along a medial side surface or a lateral side surface of the foot in a space inside or outside the main portion so as to cover the medial side surface or the lateral side surface of the foot, wherein: the side panel includes the second eyelet and the movable portion; the first side edge portion including the first eyelets formed therein is divided into pieces, one on a front side and the other on a rear side of the side panel, thus forming a division portion in the main portion; and the side panel is arranged in the division portion.

While the side edge portion in which the eyelets are formed has a large rigidity, if it is divided into pieces, the main portion is more easily bent and the second eyelet is easily displaced toward the front side or the rear side.

In this case, it is preferred that a front gap is provided between a front edge of the division portion and a front edge of the side panel, the front gap allowing the side panel, which extends in the diagonally rearward and downward direction, to come closer toward the front side, whereby the second eyelet provided in the side panel can relatively move, with respect to the first eyelets, toward a front side in the diagonal front-back direction and in the transverse direction.

With the provision of the front gap, the side panel can be relatively displaced and come closer to the front edge of the division portion.

On the other hand, it is preferred that a rear gap is provided between a rear edge of the division portion and a rear edge of the side panel, the rear gap allowing the side panel, which extends in the diagonally rearward and downward direction, to come closer toward the rear side, whereby the second eyelet provided in the side panel can move toward the rear side in the diagonal front-back direction and in the transverse direction.

With the provision of the rear gap, the side panel can be displaced, while being deformed, and come closer to the rear edge of the division portion.

In these cases, it is more preferred that the gap gradually increases from the upper surface of the sole toward the second opening. In these cases, the entire side panel comes closer to the front edge or the rear edge, and the displacement of the second eyelet can be substantial.

In a case where the side panel forms the movable portion, it is preferred that the division portion is formed in a pocket-like shape having an inner skin and an outer skin; and the inner skin and the outer skin are apart from each other in the transverse direction at a front edge and a rear edge of the division portion.

The inner skin and the outer skin spaced apart from each other in the transverse direction do not substantially pinch the side panel therebetween, and are therefore unlikely to prevent the side panel from moving in the front-back direction.

In a case where the side panel forms the movable portion, it is preferred that the division portion is formed by a sheet-like member that has a flexural rigidity smaller than that of the main portion on a front side and a rear side of the division portion, or shrinks more easily than the main portion; and a flexural rigidity of a member forming the side panel is greater than that of the sheet-like member of the division portion.

As will be described in detail in the second embodiment, a member having a small flexural rigidity is easily creased, whereby the upper is more easily bent as the division portion deforms and shrinks when the MP joint is dorsally flexed, making it possible to reduce the expansion between the medial and lateral side surfaces of the main portion.

In this case, it is preferred that the sheet-like member forming the inner skin of the division portion is thinner than a member forming the main portion on a front side and a rear side of the division portion.

A thin inner skin can easily deform, and it will unlikely be thick when deformed.

In a case where the side panel is provided in the first embodiment, it is preferred that one or more second eyelets are provided at positions between a head and a base of a first metatarsal bone on a medial side of the foot, and not provided in an area posterior to the base of the metatarsal bone and an area anterior to the head of the metatarsal bone on the medial side of the foot.

A position between the head and the base of the metatarsal bone shrinks substantially when the MP joint is dorsally flexed. Therefore, the provision of the second eyelet in this area will reduce the slip between the shoe and the foot.

Moreover, the second eyelet is provided only in the area of the metatarsal bone, and not provided in other areas. Therefore, the upper's function of stably supporting the foot will unlikely be detracted from.

In a case where the side panel is provided in the first embodiment, it is preferred that the division portion is formed in a pocket-like shape having an inner skin and an outer skin; and the inner skin is in contact with an inner surface of the side panel, and an inner surface of the inner skin is smoother than an inner surface of the main portion.

The smooth inner surface of the inner skin has a low friction against the side surface of the foot, and can easily shrink or deform. Thus, the upper can easily deform in response to the flexion of the foot.

In a case where the side panel is provided in the first embodiment, it is preferred that an outer surface of the inner skin and an inner surface of the outer skin, which are in contact with surfaces of the side panel, are smoother than an outer surface of the main portion.

Surfaces of the inner skin and the outer skin that are in contact with the side panel are smooth, and it will unlikely hinder the free deformation and relative displacement of the side panel.

In a case where the side panel is provided in the first embodiment, it is preferred that the division portion extends from an upper surface of the sole to the second opening in a diagonal direction, which slopes up in a front direction, and the inner skin and the outer skin are formed by a woven fabric, a knit fabric or a meshed sheet-like material (sheet-like member) capable of stretching in the diagonal direction.

The meshed sheet-like material as used herein may be any porous sheet that is meshed so that it does not easily stretch in the front-back direction and the up-down direction while easily stretching diagonally, and the meshed sheet-like material includes a material obtained by forming many holes in a resin sheet and a material obtained by coating a woven fabric with a resin and then making holes therein, as well as a molded resin part that has many holes therein, for example.

A woven fabric, a knit fabric and a meshed sheet-like material can be easily provided with a smooth surface and has a good air-permeability, as compared with a non-woven fabric. These sheet-like materials can easily be sheared in the plane along the sheet surface. Thus, the inner skin or the outer skin made from these sheet-like materials will easily follow deformation of the foot.

In a case where the side panel is provided in the first embodiment, it is preferred that the side panel includes a bottom portion fixed to the sole, a tip portion which forms the second side edge portion, and a middle portion which connects between the bottom portion and the second side edge portion and forms the movable portion; and the middle portion and second side edge portion are connected to the sole only via the bottom portion.

The side panel is fixed to the sole via the bottom portion, and is not fixed to the upper via the middle portion. Therefore, the side panel can be deformed and displaced freely over a long area including the middle portion and the tip portion. Thus, the displacement of the second eyelet formed in the tip portion can be substantial in the diagonal front-back direction.

In the second embodiment, it is preferred that one or more second eyelets are provided at positions between a head and a base of a first metatarsal bone on a medial side of the foot, and not provided in an area posterior to the base of the metatarsal bone and an area anterior to the head of the metatarsal bone on the medial side of the foot.

The upper shrinks substantially when the MP joint is dorsally flexed in an area between the head and the base of the metatarsal bone. Therefore, with the provision of the second eyelet in this area, the second eyelet will follow the movement of the foot and reduce the slip between the shoe and the foot.

Moreover, the second eyelet is provided only in the area of the metatarsal bone, and not provided in other areas. Therefore, the upper's function of stably supporting the foot will unlikely be detracted from.

In the second embodiment, it is preferred that the sheet-like member of the division portion is thinner than a member forming the main portion on a front side and a rear side of the division portion.

A thin inner skin can easily deform, and it will unlikely be thick when deformed.

In the second embodiment, it is preferred that the division portion is formed in a pocket-like shape having an inner skin and an outer skin; and the inner skin is in contact with an inner surface of the side panel, and an inner surface of the inner skin is smoother than an inner surface of the main portion.

The smooth inner surface of the inner skin has a low friction against the side surface of the foot, and can easily shrink or deform. Thus, the upper can easily deform in response to the flexion of the foot.

In the second embodiment, it is preferred that an outer surface of the inner skin and an inner surface of the outer skin, which are in contact with surfaces of the side panel, are smoother than an outer surface of the main portion.

Surfaces of the inner skin and the outer skin that are in contact with the side panel are smooth, and it will unlikely hinder the free deformation of the side panel.

In the second embodiment, it is preferred that the division portion extends from an upper surface of the sole to the second opening in a diagonal direction, which slopes up in a front direction, and the inner skin and the outer skin are formed by a woven fabric, a knit fabric or a meshed sheet-like material capable of stretching in the diagonal direction.

A woven fabric, a knit fabric and a meshed sheet-like material can be easily provided with a smooth surface and has a good air-permeability, as compared with a non-woven fabric. These sheet-like materials can easily be sheared in the plane along the sheet surface. Thus, the inner skin or the outer skin made from these sheet-like materials will easily follow deformation of the foot.

In the second embodiment, it is preferred that the bottom portion of the side panel is fixed to the sole, and the middle portion and tip portion are connected to the sole only via the bottom portion.

The side panel is fixed to the sole via the bottom portion, and is not fixed to the upper via the middle portion. Therefore, the side panel can be deformed and displaced freely over a long area including the middle portion and the tip portion. Thus, the displacement of the second eyelet formed in the tip portion can be substantial in the diagonal front-back direction.

In this case, it is preferred that a front gap is provided between a front edge of the division portion and a front edge of the side panel, the front gap allowing the side panel, which extends in a diagonally front direction from the sole toward the second opening, to come closer to the front edge of the division portion, whereby the second eyelet provided in the side panel can relatively move, with respect to the first eyelets, toward a front side in the diagonal front-back direction.

With the provision of the front gap, the side panel can be relatively displaced to come closer to the front edge of the division portion.

On the other hand, it is preferred that a rear gap is provided between a rear edge of the division portion and a rear edge of the side panel, the rear gap allowing the side panel, which extends in a diagonally front direction from the sole toward the second opening, to come closer to the rear edge of the division portion, whereby the second eyelet provided in the side panel can relatively move toward a rear side in the diagonal front-back direction.

With the provision of the rear gap, the side panel can be displaced, while being deformed, and come closer to the rear edge of the division portion.

In a preferred embodiment of the present invention, the second eyelet is arranged only in the area from the metatarsal phalangeal joint (so-called the "MP joint") of the first toe to the Lisfranc joint of the fourth toe in the front-back direction of the foot.

In this case, the area has a significant influence on the fitness property of the upper. Thus, the fitness property of the upper will increase if the second eyelet is arranged in such an area.

In this case, the second eyelet is not arranged in an area anterior to the MP joint of the first toe or an area posterior to the Lisfranc joint of the fourth toe. Therefore, the foot support by the upper will not become unstable.

In a more preferred embodiment, the second eyelet on the medial side of the foot is arranged only at a position posterior to the metatarsal phalangeal joint of the first toe and anterior to the base of the metatarsal bone of the first toe; and the second eyelet on the lateral side is arranged only at a position posterior to a metatarsal phalangeal joint of the fourth toe and anterior to a base of a metatarsal bone of the fourth toe.

In the present invention, if second eyelets are arranged at such positions, a pair of second eyelets move in the diagonal front-back direction.

This movement will prevent an increase in the change of the tensile force on the shoelace means engaged with the second eyelet. Thus, the upper will have a high fitness property.

If second eyelets are not arranged at positions other than those described above, the foot support will unlikely become unstable.

In a preferred embodiment of the present invention, one or two, but not three or more, second eyelets are provided on the medial side of the foot; and one or two, but not three or more, second eyelets are provided on the lateral side of the foot.

If three or more second eyelets are provided on the medial side or the lateral side of the foot, the width of the division portion increases, thereby making the foot support unstable and increasing the cost. Therefore, it is preferred that there are two or less second eyelets on each of the medial and lateral sides of the foot.

The second eyelet loosens the fastening of the upper by the shoelace. Therefore, it will be preferred that the number of second eyelets is smaller than the number of first eyelets.

Moreover, it is presumed that it is more preferred that the number of second eyelets is only one on each of the medial side and the lateral side of the foot.

In view of the above, it will be preferred that the first eyelets are arranged so as to oppose each other in each of the first half and the second half of the second opening in the front-back direction.

The first eyelets stabilize the foot support. Therefore, a plurality of second eyelets may be provided on the medial side or the lateral side, and the first eyelet may be provided between the plurality of second eyelets on the medial side or the lateral side.

In this embodiment, the side panel is provided in a space inside or outside the main portion.

In the present invention, the space inside the main portion means a space defined by the main portion, referring to a space inside of the exterior material of the main portion, and includes the space between the interior material and the exterior material in a case where the interior material exists. Therefore, where the main portion includes the exterior material and the interior material, each panel may be arranged between the interior material and the exterior material. That is, the present invention encompasses cases where each panel contacts the side surface or the instep of the foot via the interior material therebetween.

In the present invention, if the side panel is provided in the space outside the main portion, the side panel wraps around the side surface of the foot via the main portion.

In this embodiment, it is preferred that the second eyelets are arranged only in an area from the MP joint of the first toe to the Lisfranc joint of the fourth toe in the front-back direction of the foot.

EMBODIMENTS

The present invention will be understood more clearly from the following description of preferred embodiments taken in conjunction with the accompanying drawings. Note however that the embodiments and the drawings are merely illustrative, and the scope of the present invention shall be defined by the appended claims. In the accompanying drawings, like reference numerals denote like components throughout the plurality of figures.

First Embodiment

A first embodiment of the present invention will now be described with reference to FIGS. 1 to 9.

A shoe for the left foot will be illustrated in the following description. In the following figures, the arrow OUT represents the lateral side direction of the foot, and the arrow IN represents the medial side direction of the foot.

General Structure of Shoe:

A shoe having a lace fitting structure shown in FIG. 1 includes a sole 1, an upper 2, and a shoelace 3.

The sole 1 is for absorbing an impact of landing. The upper 2 is for wrapping around the instep, and includes a tongue 4 (a portion of the main portion). The shoelace 3 is for fitting an upper 2 to the instep.

Figure 2:
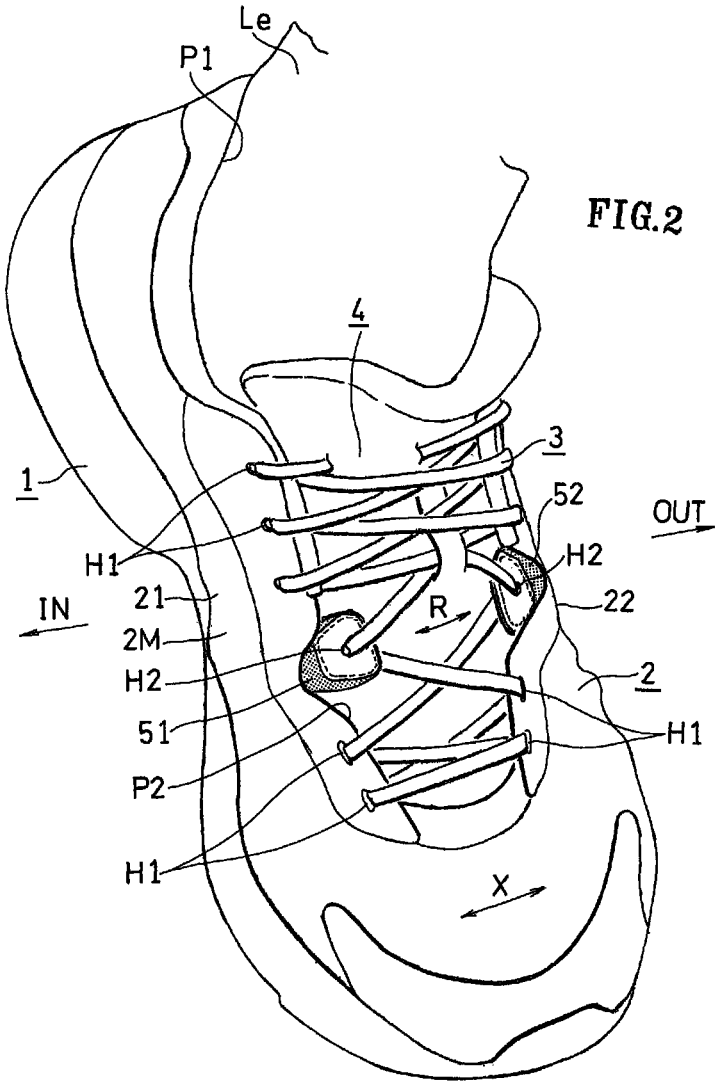
FIG. 2 is a schematic perspective view showing the shoe of the embodiment in a dorsally-flexed state achieved by wearing the shoe and raising the heel.

Although the end portions of the shoelace 3 are not shown in FIGS. 1 and 2, the end portions are firmly tied together after the foot is inserted into the upper 2. With the end portions of the shoelace 3 tied together, the upper 2 can tightly fit to the foot.

Note that the end portions of the shoelace 3 may be firmly engaged with a fixture provided on the upper 2.

The upper 2 has a first opening P1 and a second opening P2. The first opening P1 is an opening from which a leg Le extends in the upward direction Z1 when the shoe is worn.

Figure 3:
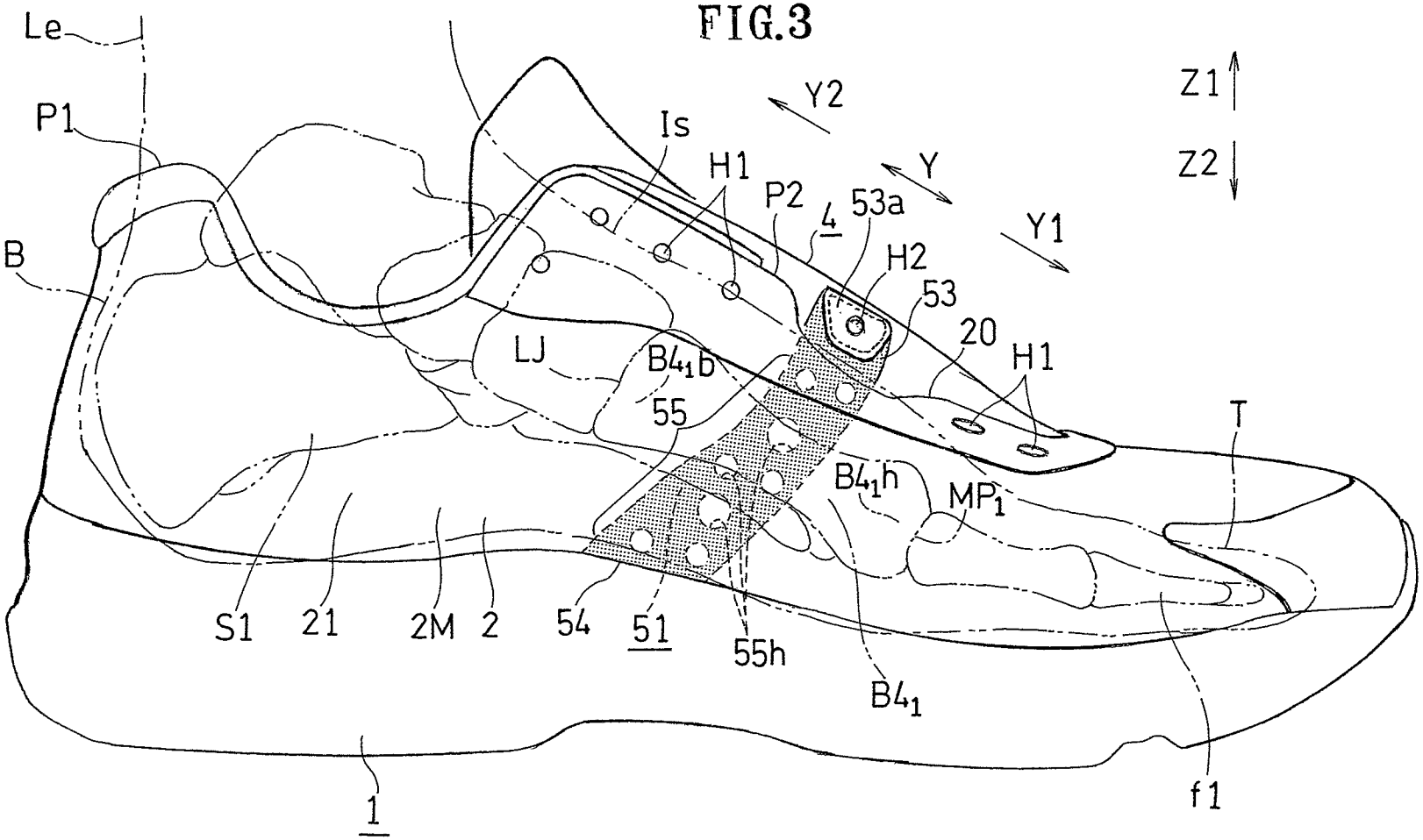
FIG. 3 is a schematic side view showing the relationship between the shoe of the embodiment and the foot bone structure as viewed from the medial side of the foot.
Figure 4:
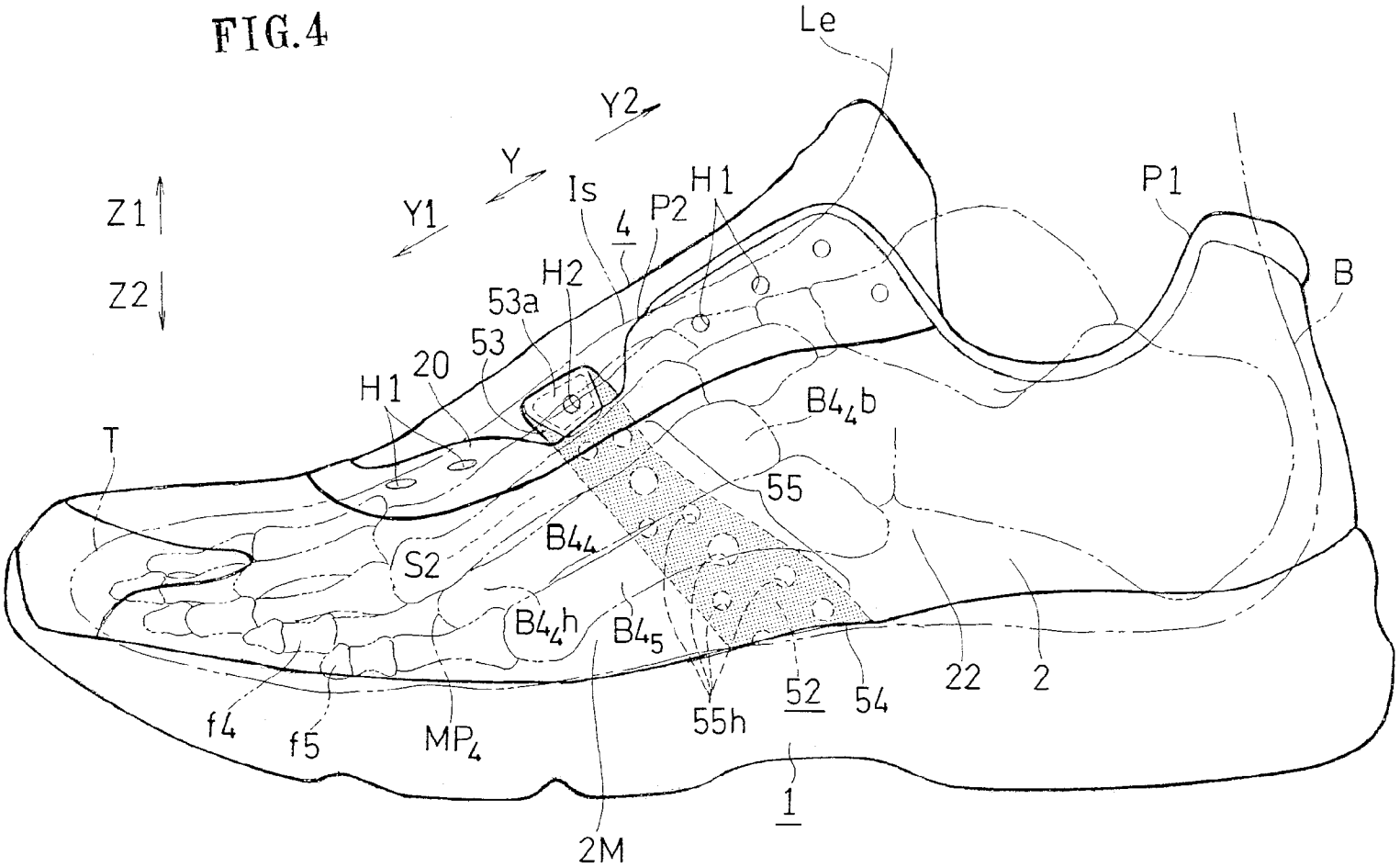
FIG. 4 is a schematic side view showing the relationship between the shoe of the embodiment and the foot bone structure as viewed from the lateral side of the foot.

As shown in FIGS. 3 and 4, the second opening P2 is an opening provided on the front side Y1 of the first opening P1, i.e., toward the toe T of the foot. In an upper portion of the upper 2, the second opening P2 is formed to be elongated in the diagonal front-back direction Y. The two openings P1 and P2 are continuous with each other. The tongue 4 closes the second opening P2 from the downward direction Z2, and wraps around the instep 1*s* from above.

Figure 5:
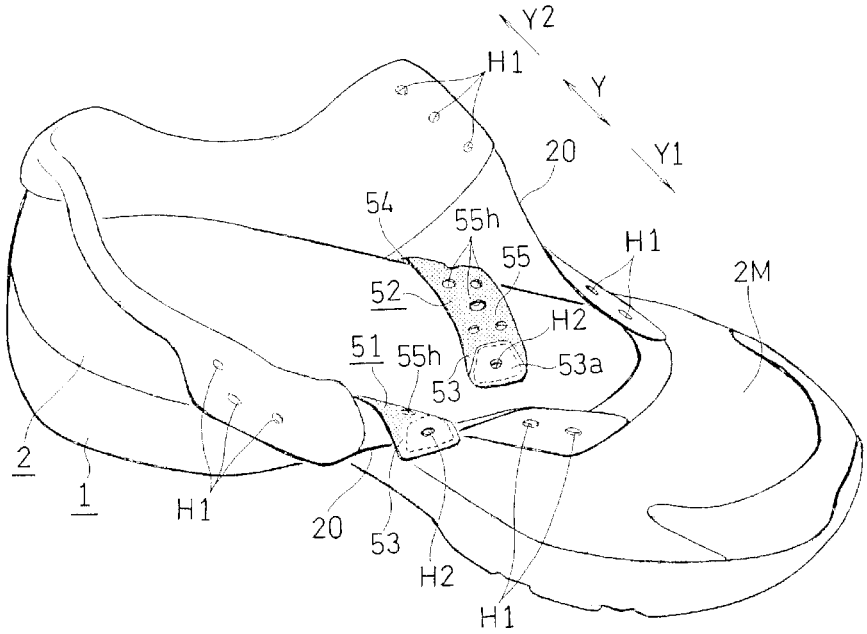
FIG. 5 is a schematic perspective view showing the inside of the shoe of the embodiment as viewed from the medial side of the foot.
Figure 6:
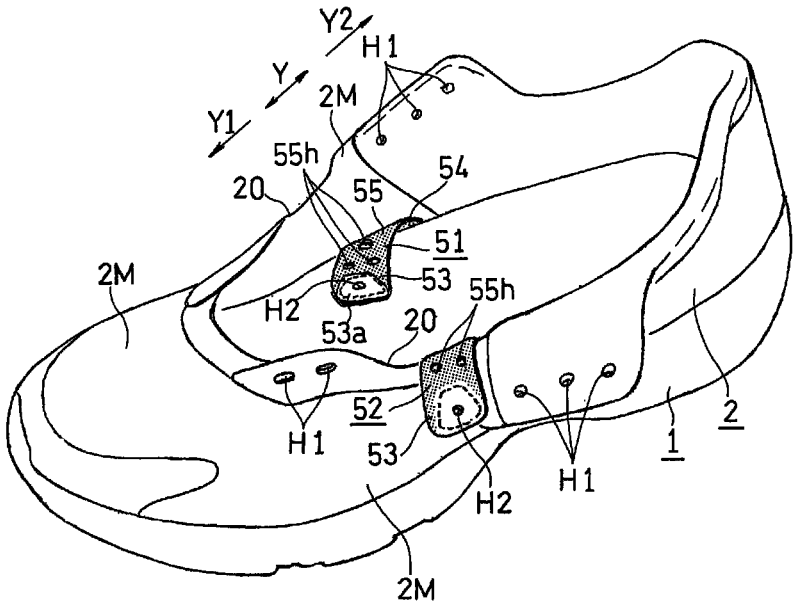
FIG. 6 is a schematic perspective view showing the inside of the shoe of the embodiment as viewed from the lateral side of the foot.

Upper 2:

In FIGS. 5 and 6, the upper 2 includes a main upper (main portion) 2M, a first side edge portion 20, and first and second side panels 51 and 52 (an example of movable portions).

Main Upper 2M:

The main upper 2M includes the medial side surface S1 of the foot of FIG. 3, the lateral side surface S2 of FIG. 4, the toe T, the instep Is, and the back surface B. The first opening P1 and the second opening P2 are formed in the main upper 2M, and the main upper 2M includes the tongue 4 which is continuous with the toe portion at the front edge of the second opening P2.

The side edge portion 20 is provided so as to surround the second opening P2 along the side edge of the second opening P2. The side edge portion 20 includes a plurality of first eyelets H1 which the shoelace 3 passes through and engages with. The side edge portion 20 is formed by an essentially non-stretching material such as an artificial leather or a tape material, for example. The first eyelets H1 are small holes formed in the side edge portion 20.

Figure 7:
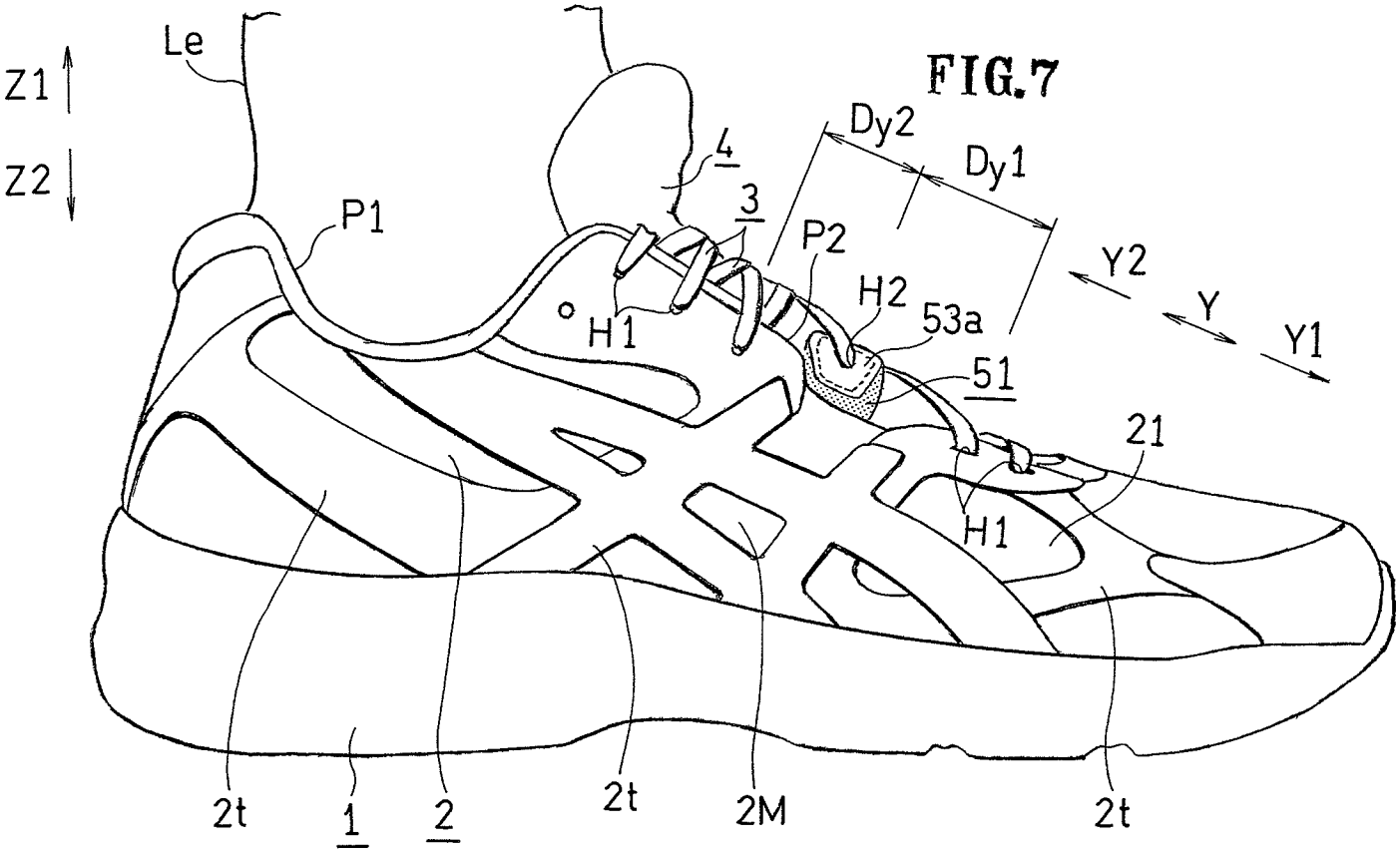
FIG. 7 is a schematic side view showing the shoe of the embodiment as viewed from the medial side of the foot.
Figure 8:
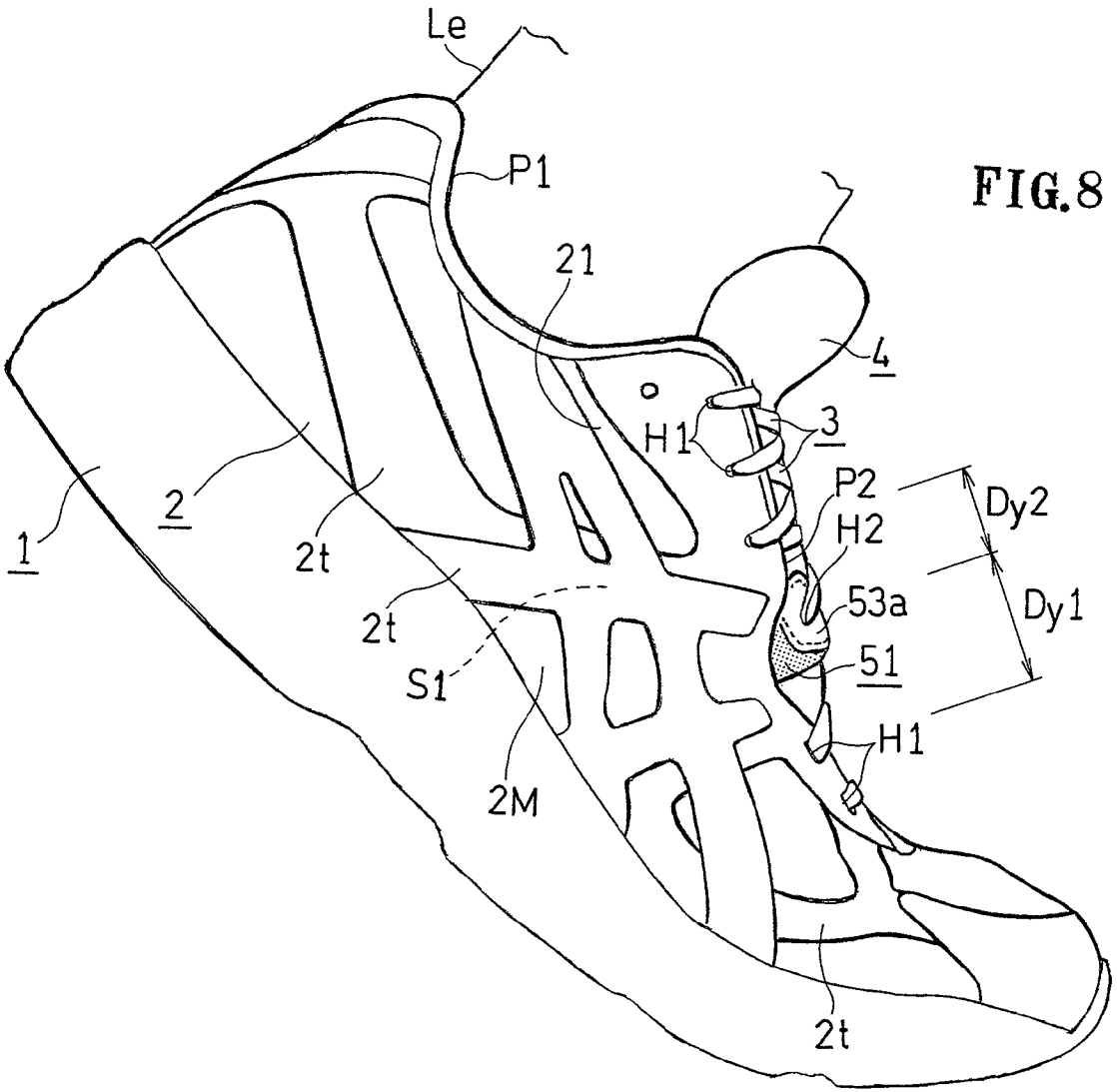
FIG. 8 is a schematic side view showing the shoe of the embodiment in a dorsally-flexed state achieved by wearing the shoe and raising the heel.

On the medial and lateral side surfaces 21 and 22 of the main upper 2M, a large number of tape materials 2*t* are sewn to the surface of the mesh member which forms a part of the main upper 2M, as clearly shown in the medial side views of FIGS. 7 and 8, for example. These tape materials 2*t* are formed by an essentially non-stretching material, and therefore the medial side surface 21 of the main upper 2M and the lateral side surface 22 of FIG. 1 are essentially non-stretching in the front direction Y1 and the rear direction Y2 of the diagonal front-back direction Y and in the circumference direction R.

The tape materials 2*t* are a well-known structure, and are therefore not shown or simplified in FIGS. 1 to 6.

Figure 9:
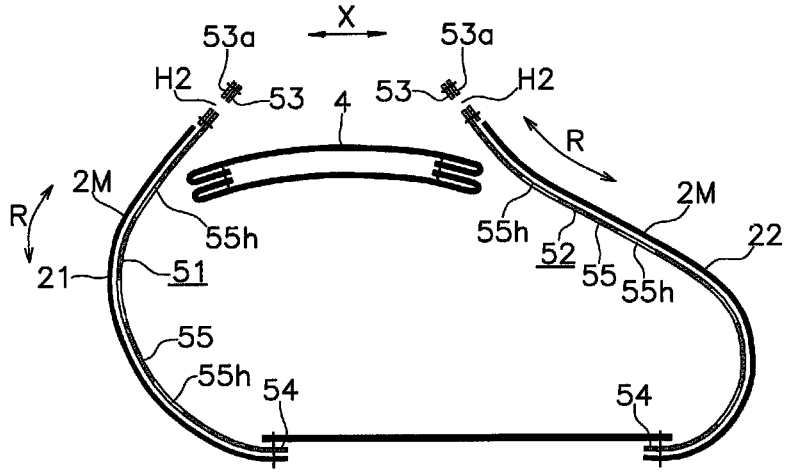
FIG. 9 is a cross-sectional view of the upper obtained by cutting the shoe of the embodiment in an area including the second eyelet and the side panel.

In FIG. 9, the side panels 51 and 52 include second eyelets H2. The side panels 51 and 52 each include a tip portion (second side edge portion) 53, a bottom portion 54 fixed to the sole 1 and the main upper 2M, and a middle portion 55 (an example of a movable portion) between the tip portion 53 and the bottom portion 54, which are continuous with one another as an integral member.

The tip portion 53 is connected to the main upper 2M and the sole 1 only via the middle portion 55 and the bottom portion 54. The bottom portion 54 may be sewn to the main upper 2M without being fixed to the sole 1.

In the tip portion 53, an eyelet member 53*a* is sewn to the tape material which forms a part of the side panels 51 and 52. In FIGS. 1 to 8, areas of the side panels 51 and 52 in which the eyelet member 53*a* is not provided are dotted.

The second eyelet H2 is a small hole formed in the tip portion 53 and the eyelet member 53*a*, which the shoelace 3 of FIG. 1 passes through and engages with.

While the first eyelets H1 and the second eyelets H2 are numbered in subscript from front to back in order to distinguish the eyelet positions in the diagonal front-back direction Y from one another in FIG. 1, the numbers in subscript may be omitted in the description of the embodiments and in FIG. 2 and subsequent figures.

In the present specification, the diagonal front-back direction Y refers to a direction that is orthogonal to the transverse direction X across the second opening P2 and is generally parallel to the direction in which the eyelets H1 and H2 are arranged, and is typically a diagonally front direction and a diagonally rear direction with respect to the bottom surface of the sole 1.

The first side panel 51 of FIG. 3 is formed in a band-like shape, and wraps around the medial side surface S1 of the foot in an upward or diagonally upward direction (a direction which slopes up in a front direction) along the medial side surface S1 in the space inside the main upper 2M, covering a portion of the medial side surface S1.

The second side panel 52 of FIG. 4 is formed in a band-like shape, and wraps around the lateral side surface S2 of the foot in an upward or diagonally upward direction along the lateral side surface S2 in the space inside the main upper 2M, covering a portion of the lateral side surface S2.

The middle portion 55 is arranged between the tip portion 53 and the bottom portion 54, and is not attached to the main upper 2M, as clearly shown in FIGS. 5 and 6. Therefore, the middle portion 55 allows the tip portion 53 to move in the diagonal front-back direction Y with respect to the bottom portion 54. On the other hand, the middle portion 55 of the side panels 51 and 52 forms the stretchable portion (movable portion), and can stretch and shrink to increase the length from the tip portion 53 to the bottom portion 54.

In the present embodiment, as the middle portion 55 stretches, the second eyelet $H2_3$ is relatively displaced with respect to the first eyelet H1 of the main upper 2M both in the transverse direction X of FIG. 1 and in the rear direction Y2 of the diagonal front-back direction Y of FIG. 7.

The tape material of the side panels 51 and 52 and the eyelet member 53*a* are formed by an essentially non-stretching material.

However, as clearly shown in FIGS. 3 and 4, a plurality of circular through holes 55*h* are formed in a staggered pattern in the middle portion 55 of the side panels 51 and 52 of FIG. 5. When a substantial tensile force is applied in the direction in which the side panels 51 and 52 extend, the shapes of the through holes 55*h* deform into elliptic shapes, and the middle portion 55 extends in the circumference direction R of the foot (FIGS. 1 and 2). In the present embodiment, the second eyelet $H2_3$ is displaced in the transverse direction X (FIGS. 1 and 2) with respect to the main upper 2M also by the middle portion 55 stretching in the circumference direction R of the foot.

The second eyelet H2 on the medial side of FIG. 3 is arranged in an area from the MP joint $MP_1$ of the first toe f1 to the Lisfranc joint LJ of the first toe f1. Preferably, the second eyelet H2 on the medial side of the foot of FIG. 3 is arranged at a position posterior Y2 to the head $B4_1h$ of the metatarsal bone $B4_1$ of the first toe f1 and anterior Y1 to the base $B4_1b$ of the metatarsal bone $B4_1$ of the first toe f1.

On the other hand, the second eyelet H2 on the lateral side of FIG. 4 is preferably arranged at a position posterior Y2 to the head $B4_4h$ of the metatarsal bone $B4_4$ of the fourth toe f4 and anterior Y1 to the base $B4_4b$ of the metatarsal bone $B4_4$ of the fourth toe f4.

Preferably at least a pair of medial and lateral first eyelets H1, and more preferably a plurality of pairs of first eyelets H1, is provided on the front side Y1 of the second eyelet H2, as shown in FIGS. 3 and 4.

Preferably at least a pair of medial and lateral first eyelets H1, and more preferably a plurality of pairs of first eyelets H1, is provided on the rear side Y2 of the second eyelet H2.

The upper is fastened by the shoelace inserted through the first eyelets H1, thereby stabilizing the support.

The first side panel 51 of FIG. 3 tapers from the bottom portion 54 toward the tip portion 53 in a diagonally forward and upward direction. The middle portion 55 of the first side panel 51 is arranged along an area that is posterior Y2 to the head $B4_1h$ of the metatarsal bone $B4_1$ of the first toe f1 and anterior Y1 to the base $B4_1b$ of the metatarsal bone $B4_1$ of the first toe f1 (the shaft of the metatarsal bone $B4_1$ of the first toe f1).

On the other hand, the second side panel 52 of FIG. 4 tapers from the bottom portion 54 toward the tip portion 53 in a diagonally forward and upward direction. The middle portion 55 of the second side panel 52 is arranged along an area that is posterior Y2 to the head $B4_4h$ of the metatarsal bone $B4_4$ of the fourth toe f4 and anterior Y1 to the base $B4_4b$ of the metatarsal bone $B4_4$ of the fourth toe f4 (the shaft of the metatarsal bone $B4_4$ of the fourth toe f4).

Second Embodiment

Figure 10:
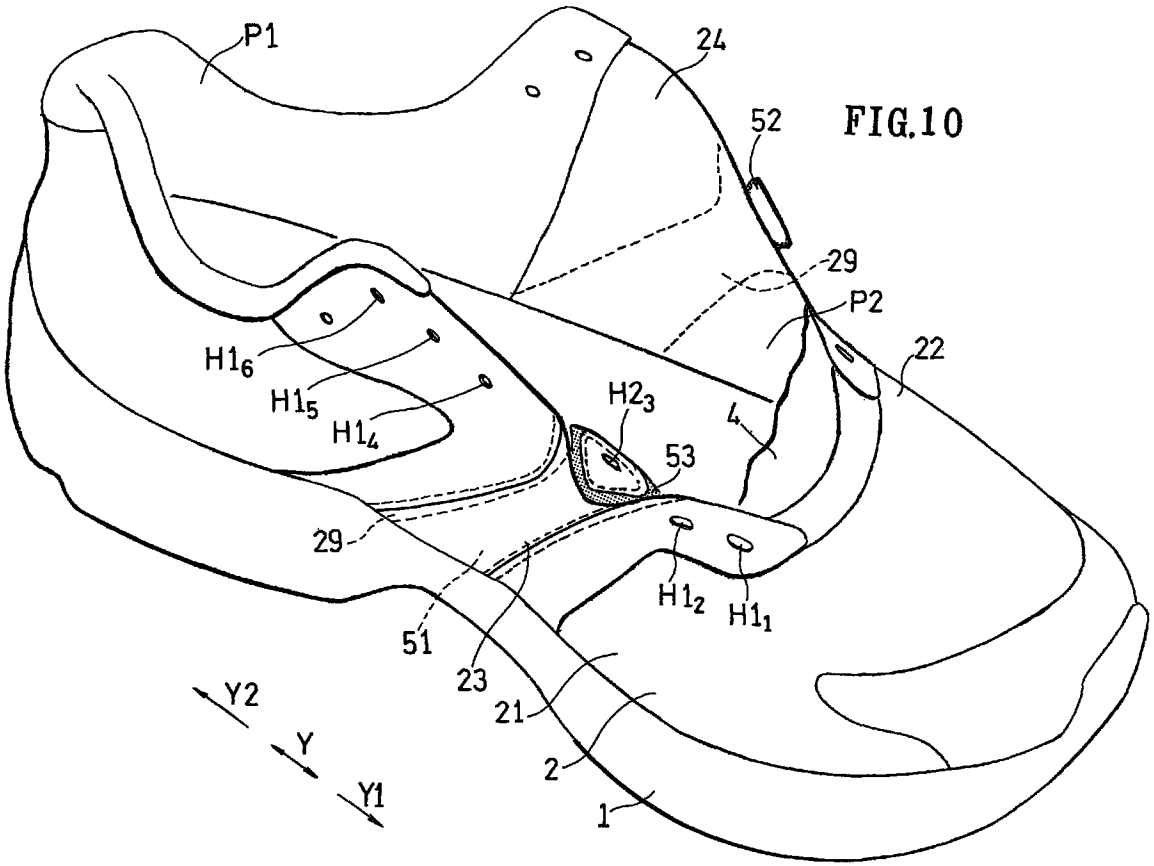
FIG. 10 is a schematic perspective view showing a shoe of a second embodiment.
Figure 11:
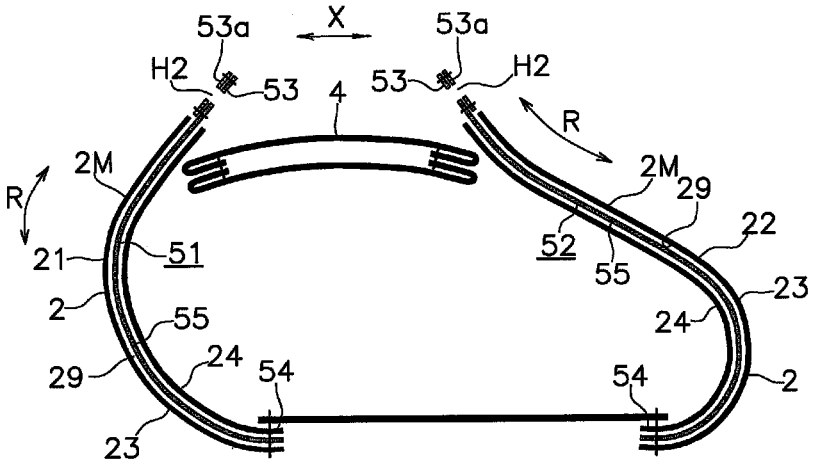
FIG. 11 is a cross-sectional view of the upper obtained by cutting the shoe of the embodiment in an area including the second eyelet and the side panel.

FIGS. 10 and 11 show a second embodiment.

In the second embodiment, the main upper 2M includes a bag-like housing 29 for accommodating the middle portion 55 (movable portion) of the side panels 51 and 52. The tip portion 53 of the side panels 51 and 52 protrudes from the housing 29.

The medial and lateral side surfaces 21 and 22 of the main upper 2M of FIG. 11 are each formed by sewing together a front surface material 23 and a back surface material 24 as shown in FIG. 10. The housing 29 is formed between the two members 23 and 24 sewn together.

The side panels 51 and 52 are each formed in a band-like shape that conforms to the shape of the housing 29.

The side panels 51 and 52 may have a stretchable portion including the through holes 55*h* formed in the middle portion 55, as in the first embodiment, or may be formed by a resin tape having rubber elasticity instead of forming the through holes 55*h*.

The term "rubber elasticity" means a property of being able to repeatedly stretch and shrink (elastically deform) without substantial plastic deformation, such as vulcanized rubber.

The configuration of the second embodiment is otherwise similar to that of the first embodiment, and like elements to those of the first embodiment are denoted by like reference numerals and will not be further described below.

Third Embodiment

Next, a third embodiment will be described with reference to FIGS. 12 to 15B.

In the third embodiment, the first eyelets H1 are provided in a first side edge portion 20A of the main upper 2M, whereas the second eyelet H2 is provided in a second side edge portion 20B which is continuous with the main upper 2M. An eyelet member 53*b* forming a portion of the second side edge portion 20B is surrounded by a stretchable portion 5 (an example of a movable portion).

Figure 12:
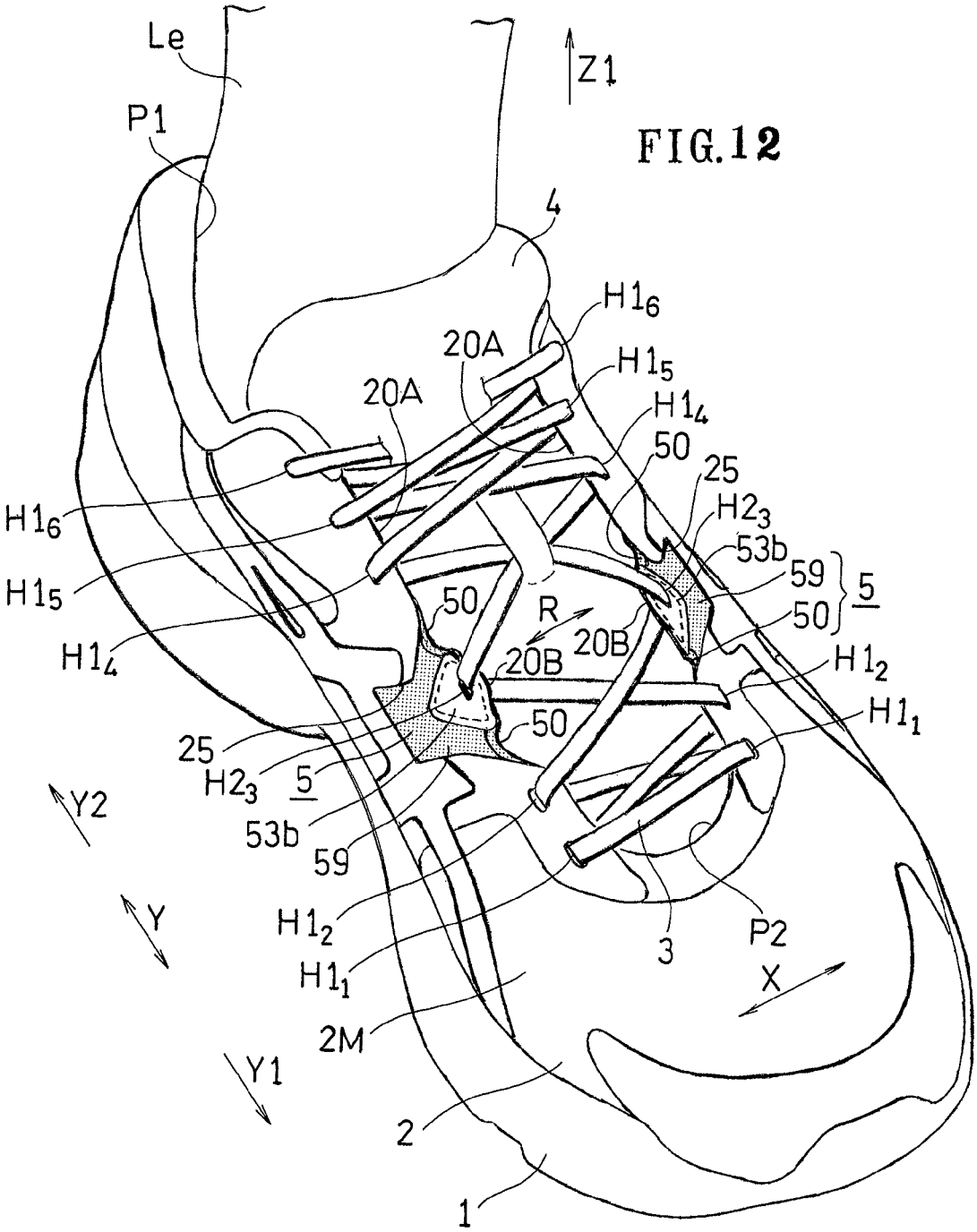
FIG. 12 is a schematic perspective view showing a shoe according to a third embodiment of the present invention.
Figure 13:
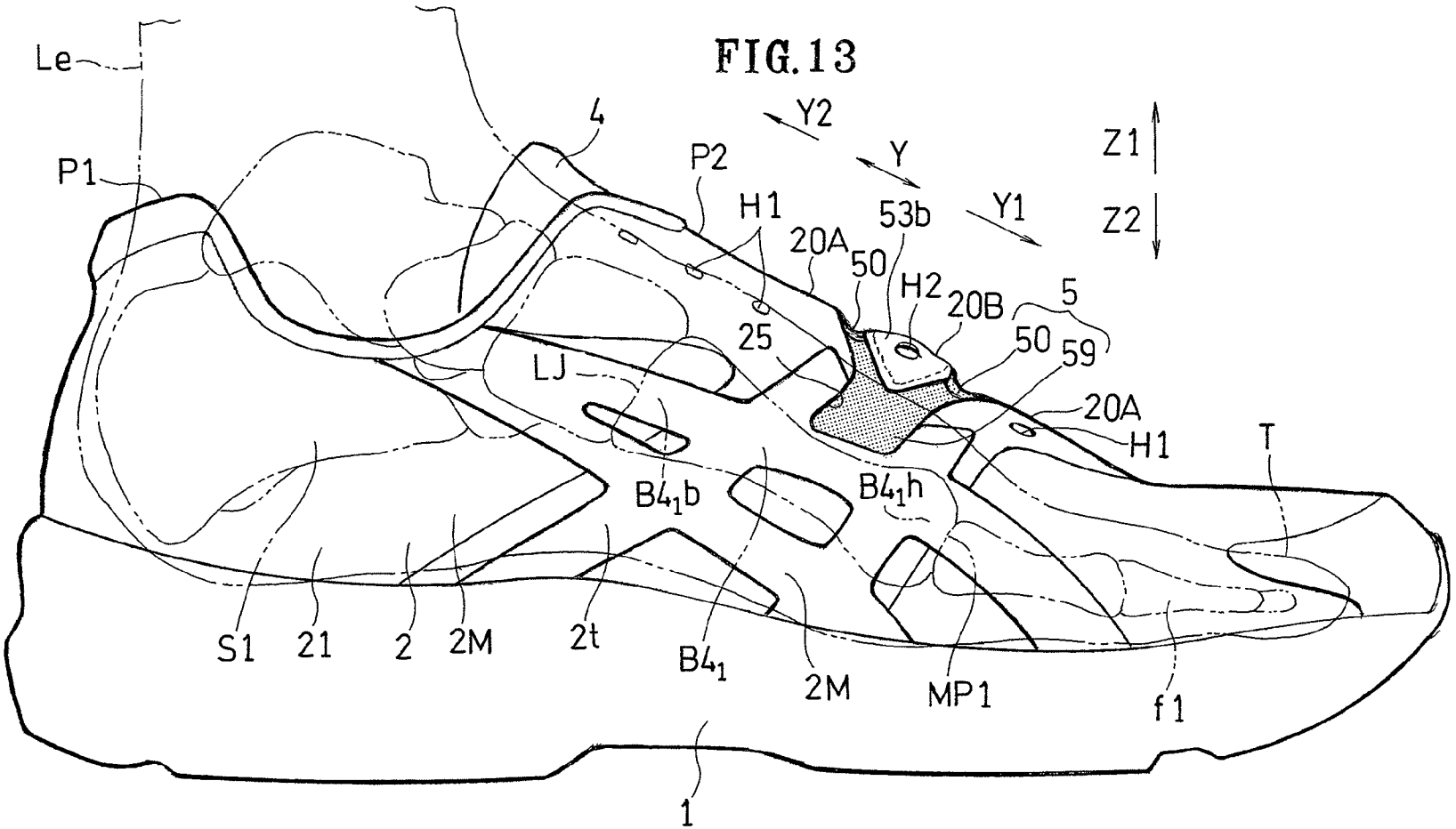
FIG. 13 is a schematic side view showing the relationship between the shoe of the embodiment and the foot bone structure as viewed from the medial side of the foot.
Figure 14:
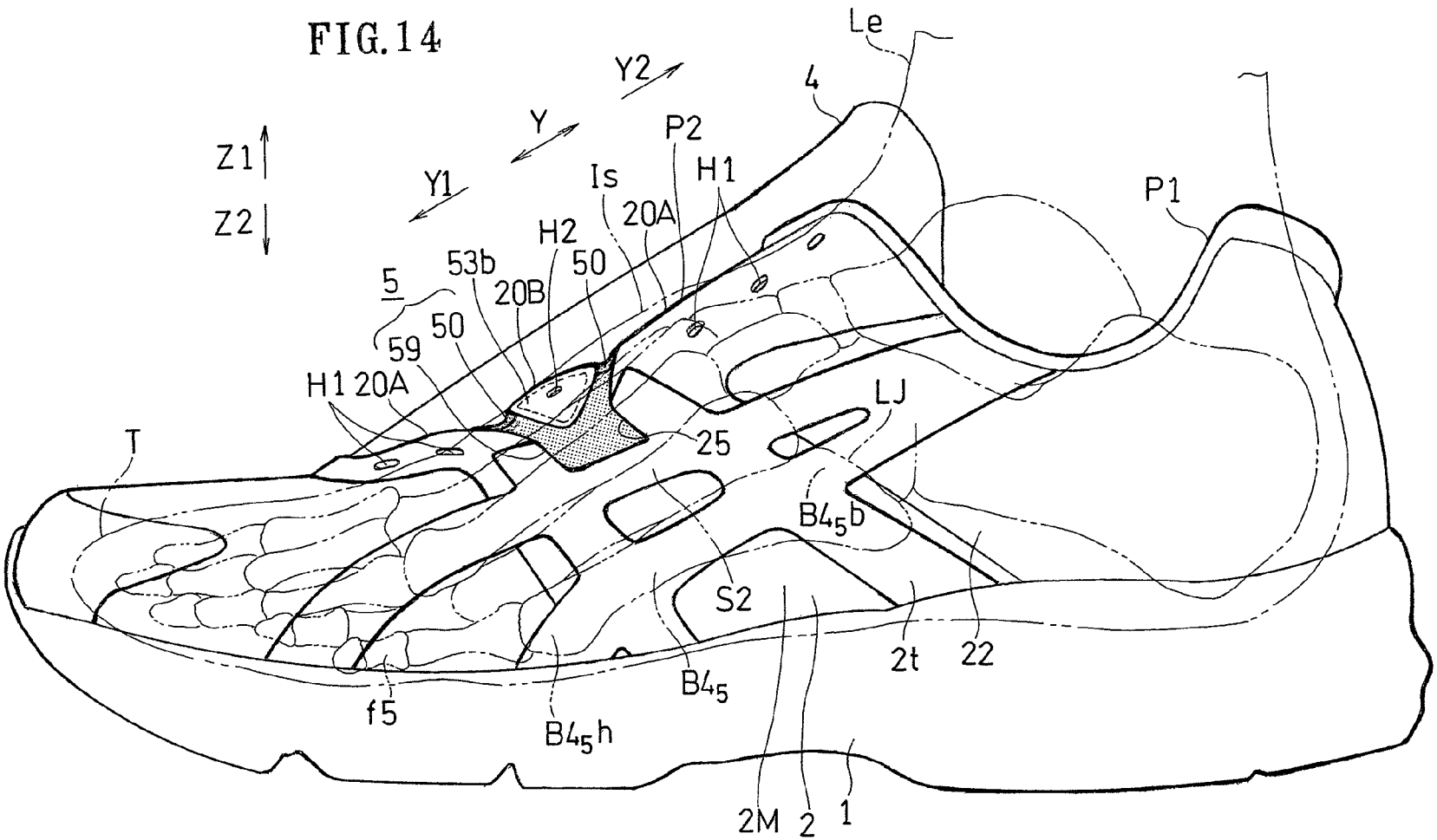
FIG. 14 is a schematic side view showing the relationship between the shoe of the embodiment and the foot bone structure as viewed from the lateral side of the foot.

In FIGS. 12 to 14, the area of the stretchable portion 5 is dotted. The pair of medial and lateral stretchable portions 5 and 5 opposes each other with the second opening P2 interposed therebetween.

Figure 15A:
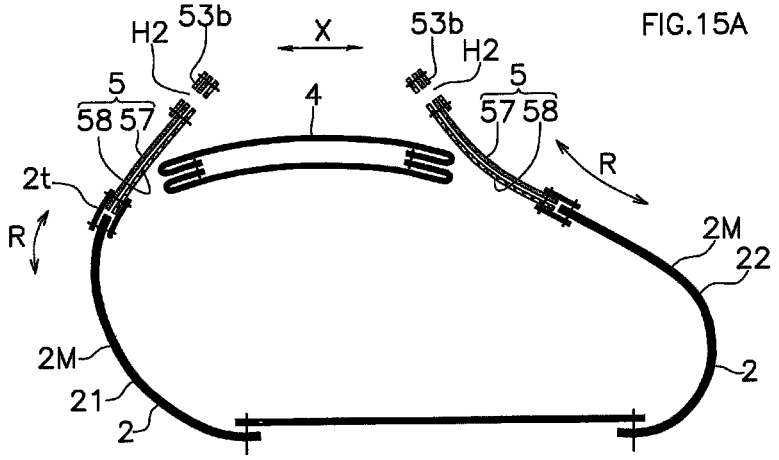
FIG. 15A is a cross-sectional view of the upper obtained by cutting the shoe of the embodiment in an area including the second eyelet and the stretchable portion.

A notch 25 is formed in the essentially non-stretching main upper 2M, and the stretchable portion 5 is formed in the area of the notch 25. The eyelet member 53*b* shown in FIG. 15A is sewn onto the members 57 and 58 forming the stretchable portion 5, and the second side edge portion 20B is an area where the members 57 and 58 and the eyelet member 53*b* overlap with each other, and is continuous with the main upper 2M only via the stretchable portion 5.

That is, the stretchable portion 5 of FIG. 12 surrounds the second side edge portion 20B, and if the stretchable portion 5 is compared to the sea and the main upper 2M to the land, the second side edge portion 20B is arranged as if it were an island off the main upper 2M which were the land. That is, the second side edge portion 20B is connected to the main upper 2M only via the stretchable portion 5.

The main upper 2M which is less stretchable than the stretchable portion 5 covers the Lisfranc joint LJ and the metatarsal bone base $B4_5b$ of the fifth toe f5 on the lateral side of the foot of FIG. 14, and the main upper 2M of FIG. 13 covers the base $B4_1b$ and the head $B4_1h$ of the metatarsal bone of the first toe f1 on the medial side of the foot.

As clearly shown in FIGS. 13 and 14, in the present embodiment, the stretchable portion 5 does not extend to the sole 1, with the main upper 2M being continuous to the diagonal front-back direction Y below the stretchable portion 5. Therefore, even with the stretchable portion portion 5 being easy-stretchable member, or even if the two stretchable portions 5 and 5 are arranged at positions opposing each other, the foot support is stable.

On the medial side of the foot, the main upper 2M may include a non-stretching member covering only one of the base $B4_1b$ and the head $B4_1h$ of the metatarsal bone of the first toe, with the other covered by a stretchable member.

As shown in FIG. 15A, the stretchable portion 5 may include a stretchable, meshed raw fabric 58 and a resin sheet 57 with rubber elasticity sewn together at the non-stretching tape material 2*t*.

Figure 15B:
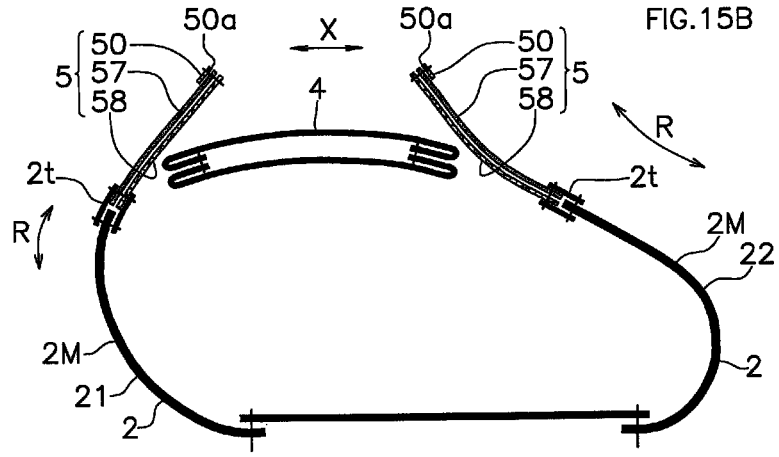
FIG. 15B is a cross-sectional view of the upper obtained by cutting the shoe of the embodiment in an area including the reinforcement material and the stretchable portion.

The stretchable portion 5 of FIG. 14 includes a first portion 50 which reinforces the stretchable portion 5 on the front side and the rear side of the second side edge portion 20B, and a second portion 59 which is the stretchable portion 5 other than the first portion 50. The first portion 50 is curved along the side edge of the stretchable portion 5, and is depressed as if it were notched. As shown in FIG. 15B, the first portion 50 is obtained by bonding and sewing a reinforcement material 50*a* onto the resin sheet 57. Although the reinforcement material 50*a* of the curved first portion 50 is formed by a material that is less stretchable than the second portion 59, it is capable of stretching in the diagonal front-back direction Y into a linear shape or shrinking by increasing its curvature, and forms a portion of the first portion 50. Thus, the curved first portion 50 suppresses the movement of the second side edge portion 20B in the diagonal front-back direction Y, thereby allowing the second eyelet H2 to move with a small force in the diagonal front-back direction Y. Therefore, the second eyelet H2 is allowed to move in the diagonal front-back direction Y and the circumference direction R.

The second portion 59 is stretchable both in the diagonal front-back direction Y and the circumference direction R.

In FIG. 12, the first portion 50 and the second portion 59 of the stretchable portion 5 are more stretchable than the side edge portions 20A and 20B and the main upper 2M and are arranged so that the vicinity of the second side edge portion 20B in the circumference direction, i.e., the second portion 59, is stretchable in the circumference direction R of the foot and the diagonal front-back direction Y when the foot is flexed and the first portion 50 is stretchable in the diagonal front-back direction Y on the front side Y1 and the rear side Y2 of the second side edge portion 20B, so that the second side edge portion 20B can move in the circumference direction R of the foot (not shown) and in the front direction Y1 and the rear direction Y2 of the diagonal front-back direction Y with respect to the main upper 2M when the foot is flexed.

It is not necessary to provide the reinforcement material 50*a* forming the first portion 50.

The configuration of the third embodiment is otherwise similar to that of the first embodiment, and like elements to those of the first embodiment are denoted by like reference numerals and will not be further described below.

Fourth Embodiment

Next, a fourth embodiment will be described with reference to FIGS. 16 to 20.

In the fourth embodiment, the first eyelets H1 are provided in the first side edge portion 20A of the main upper 2M, and the second eyelet H2 is provided in the stretchable portion 5B (an example of a movable portion) on the lateral side, of the stretchable portions 5A and 5B on the medial side and lateral side.

The areas of the stretchable portions 5A and 5B are dotted.

Figure 18:
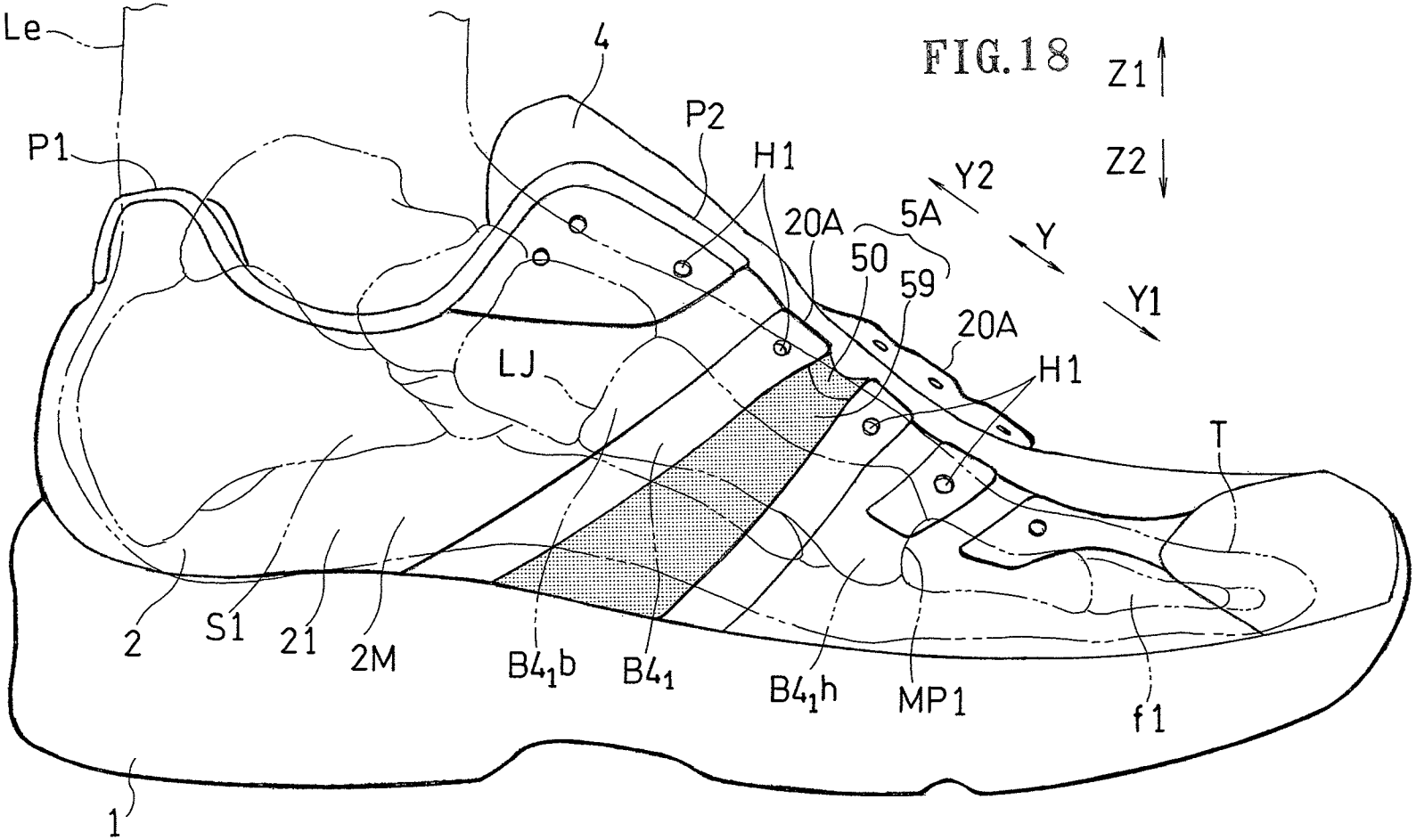
FIG. 18 is a schematic side view showing the relationship between the shoe of the embodiment and the foot bone structure as viewed from the medial side of the foot.

On the medial side of the foot of FIG. 18, the main upper 2M excluding the stretchable portion 5A, i.e., the main upper 2M that is less stretchable than the stretchable portions 5A and 5B, covers the base B$\mathbf{4}_1$b and the head B$\mathbf{4}_1$h of the metatarsal bone of the first toe f1. On the other hand, the main upper 2M covers the Lisfranc joint LJ of the fifth toe f5 and the metatarsal bone base B$\mathbf{4}_5$b on the lateral side of the foot of FIG. 19.

Figure 16:
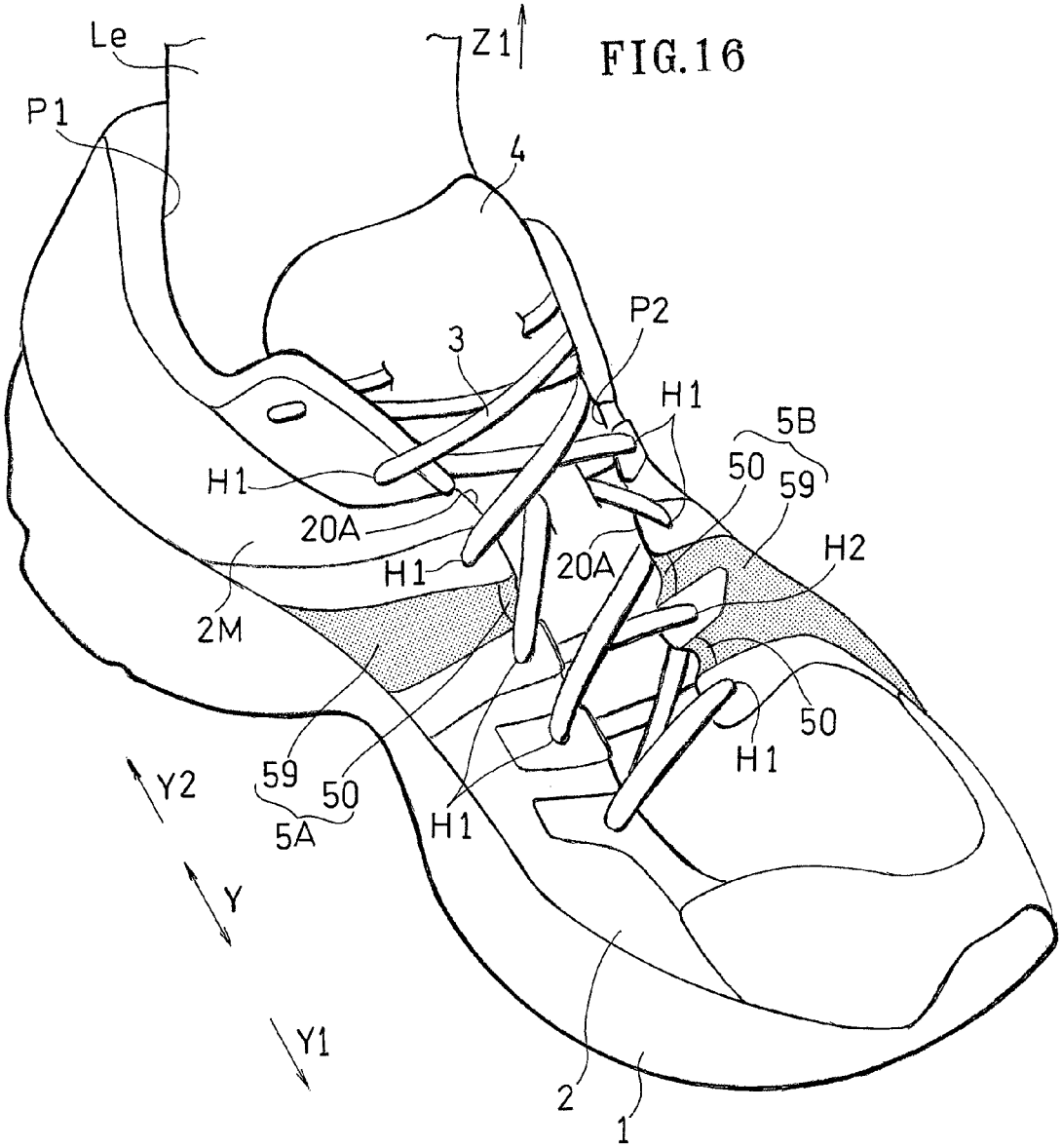
FIG. 16 is a schematic perspective view showing a shoe of a fourth embodiment of the present invention as viewed from the medial-front side of the shoe.
Figure 17:
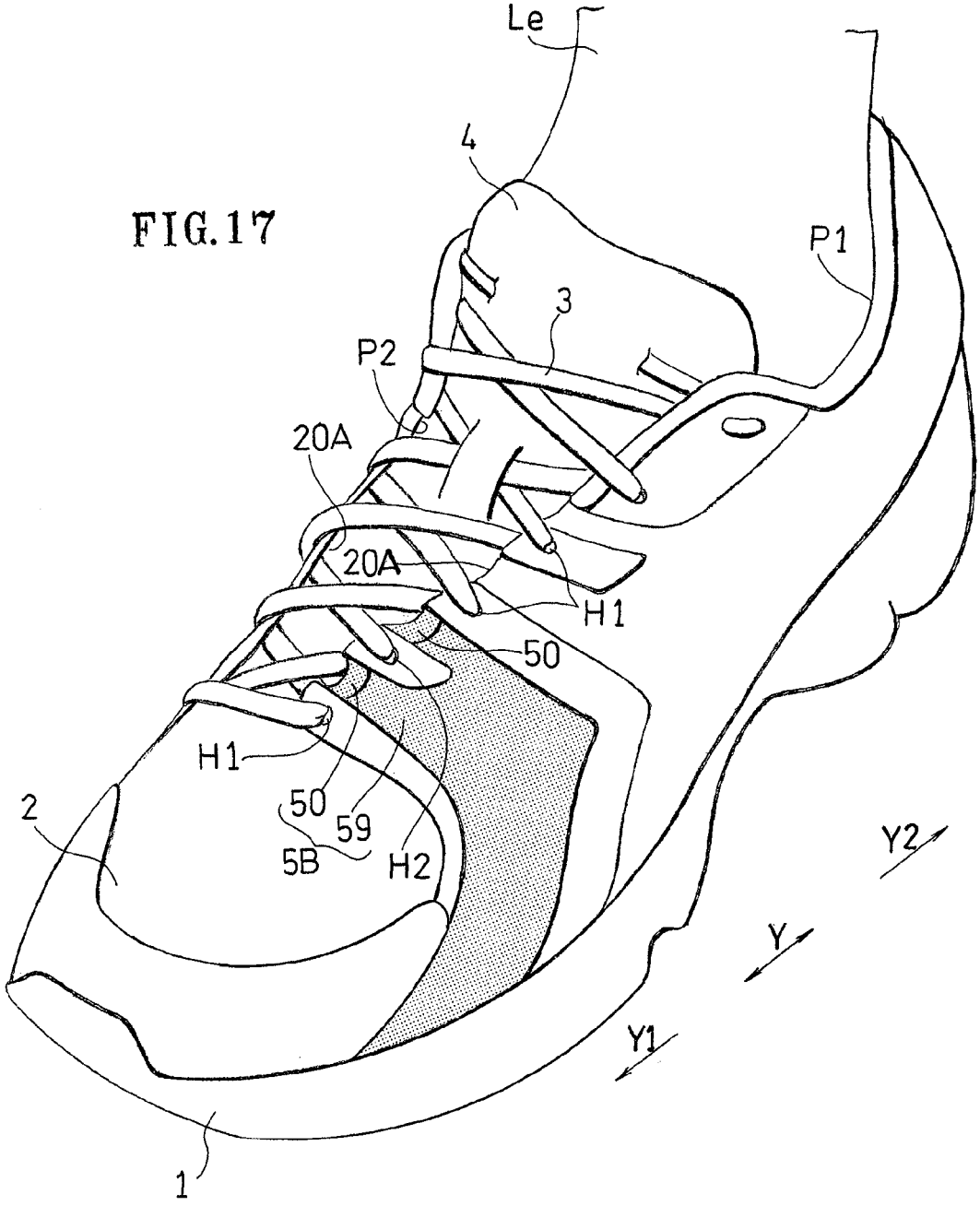
FIG. 17 is a schematic perspective view showing the shoe of the embodiment as viewed from the lateral-front side.

As shown in FIG. 16, the stretchable portion 5A and the stretchable portion 5B are arranged at positions diagonally across from each other with the second opening P2 therebetween. The stretchable portions 5A and 5B of FIGS. 17 and 18 extend across the medial and lateral side surfaces of the upper 2.

Figure 19:
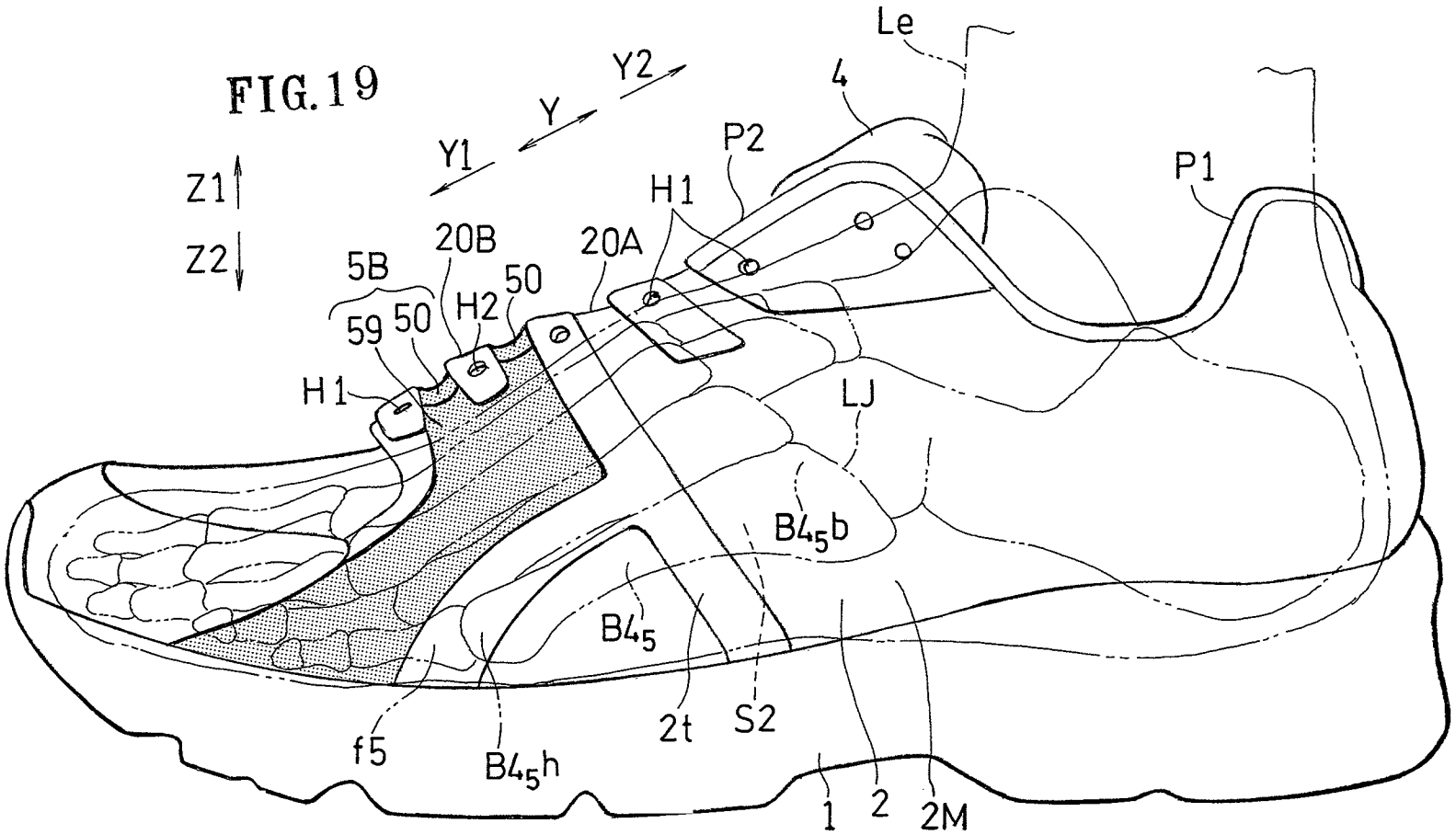
FIG. 19 is a schematic side view showing the relationship between the shoe of the embodiment and the foot bone structure as viewed from the lateral side of the foot.
Figure 20A:
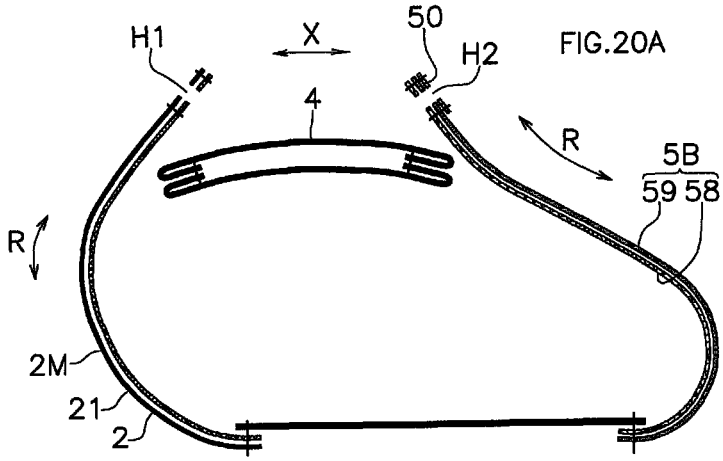
FIG. 20A is a cross-sectional view of the upper obtained by cutting the shoe of the embodiment in an area of the stretchable portion including the second eyelet.
Figure 20B:
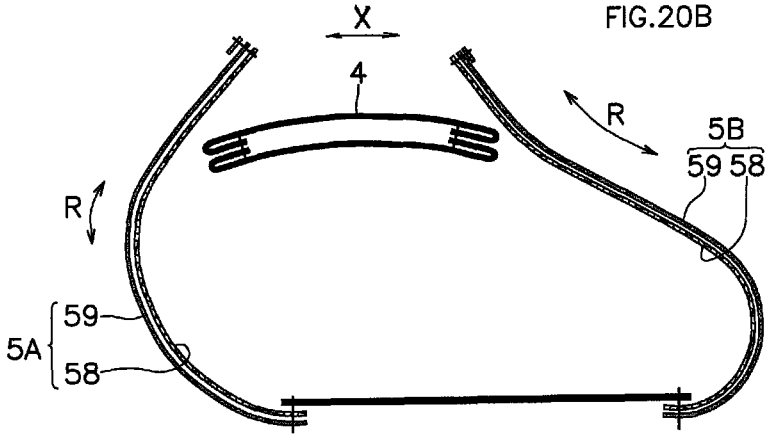
FIG. 20B is a cross-sectional view of the upper obtained by cutting the shoe of the embodiment in an area of the stretchable portion including the reinforcement portion.

As shown in FIGS. 18 and 19, the first portion 50 is provided at the upper end of the stretchable portions 5A and 5B. The first portion 50 of the stretchable portion 5B, which is configured in a curved shape, is capable of stretching in the diagonal front-back direction Y into a linear shape or shrinking by increasing its curvature, and it allows the second side edge portion 20B to move in the diagonal front-back direction Y and will unlikely prevent the movement of the second side edge portion 20B in the circumference direction R (not shown).

Thus, the second eyelet H2 moves more easily in the circumference direction R (the transverse direction X) than in the diagonal front-back direction Y.

The configuration of the fourth embodiment is otherwise similar to that of the first embodiment, and like elements to those of the first embodiment are denoted by like reference numerals and will not be further described below.

Next, test results on test examples and a reference example will be shown in order to make clear the advantages of the present invention.

First, shoes of Test Examples 1 to 4 and the reference example were provided.

Test Example 1

Shoes of Embodiment 1 shown in FIGS. 1 to 9 were produced as Test Example 1.

Test Example 2

Shoes of Embodiment 2 shown in FIGS. 10 and 11 were produced as Test Example 2. In Test Example 2, a material having a relatively low rigidity was employed for the side panel.

Test Example 3

Shoes of Embodiment 2 shown in FIGS. 10 and 11 were produced as Test Example 3. In Test Example 3, a material having a relatively high rigidity and rubber elasticity was employed for the side panel, and through holes were formed in a staggered pattern in the side panel.

Test Example 4

Shoes of Embodiment 4 shown in FIGS. 16 to 20 were produced as Test Example 4.

Reference example: In Embodiment 3 shown in FIGS. 12 to 15, the reverse surface of the stretchable material in the area corresponding to the stretchable portion was backed with an essentially non-stretching woven fabric, and it was used as the reference example. In this reference example, the area corresponding to the stretchable portion is essentially non-stretching.

Markers were attached to the vicinity of the eyelets of the shoes of the test examples and the reference example, and the shoes were put on the foot as shown in FIG. 7 to measure the following distances $D_1$ to $D_6$.

$D_1$ is the distance between markers attached to the vicinity of the first eyelets H$\mathbf{1}_1$ on the medial side and the lateral side.

$D_2$ is the distance between markers attached to the vicinity of the first eyelets H$\mathbf{1}_2$ on the medial side and the lateral side.

$D_3$ is the distance between markers attached to the vicinity of the second eyelets H$\mathbf{2}_3$ on the medial side and the lateral side.

$D_4$ is the distance between markers attached to the vicinity of the first eyelets H$\mathbf{1}_4$ on the medial side and the lateral side.

$D_5$ is the distance between markers attached to the vicinity of the first eyelets H$\mathbf{1}_5$ on the medial side and the lateral side.

$D_6$ is the distance between markers attached to the vicinity of the first eyelets H$\mathbf{1}_6$ on the medial side and the lateral side.

Then, the distance between markers was measured while raising the heel by dorsally flexing the MP joint as shown in FIG. 8 from the state of FIG. 7 so as to obtain the distance $D_1$ between markers for every 20-mm raise of the heel. This measurement was performed for the test examples and the reference example.

For the samples, the amounts of change $\Delta D_1$ to $\Delta D_6$ of $D_1$ to $D_6$ were calculated, and the results are shown in FIGS. 21A to 21C and 22A and 22B for each sample.

The results will be discussed below.

Figure 21A:
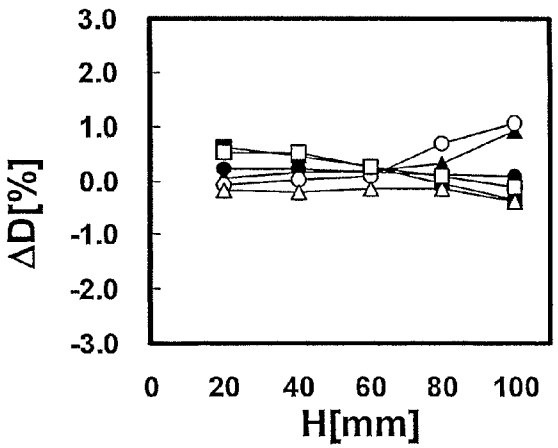
FIGS. 21A, 21B and 21C are graphs showing the relationship between the amount of heel raise H and the amount of change ΔD in the inter-eyelet distance for the shoes of Test Examples 1, 2 and 3, respectively.
Figure 21B:
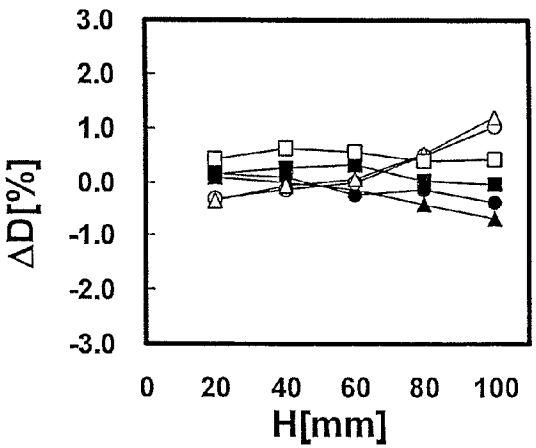
Figure 21C:
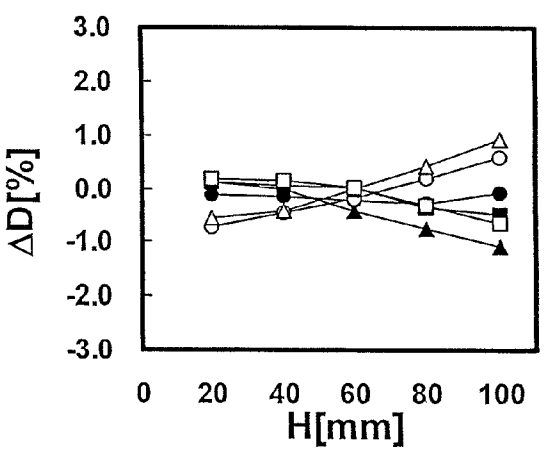
Figure 21C:
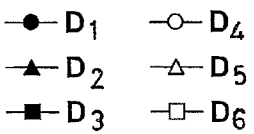
Figure 22A:
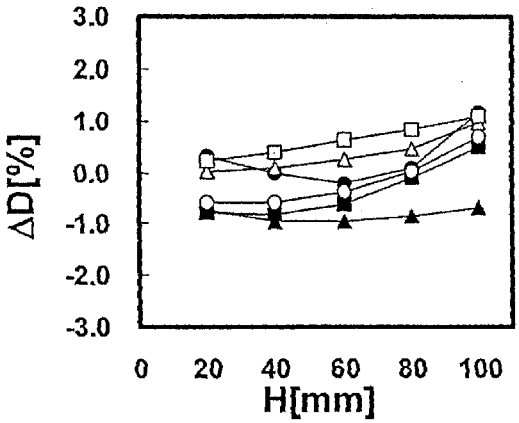
FIGS. 22A and 22B are graphs showing the relationship between the amount of heel raise H and the amount of change ΔD in the inter-eyelet distance for the shoes of Test Example 4 and a reference example, respectively.
Figure 22B:
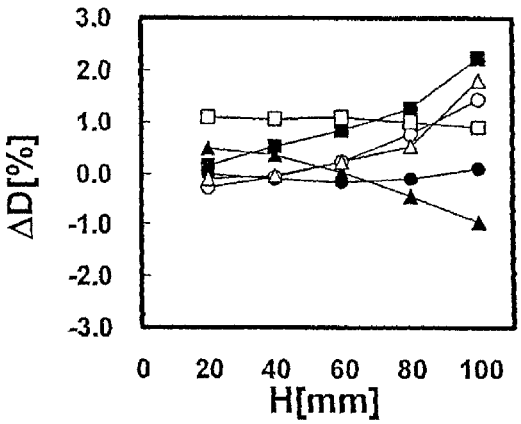
Figure 22B:
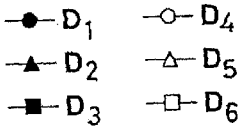

In the reference example of FIG. 22B, the amount of change $\Delta D_3$ in the distance between the second eyelets H$\mathbf{2}_3$ was over 2%. On the other hand, the $\Delta D_3$ was about ±0.5% or less in the test examples of FIGS. 21A to 21C and 22A.

It is believed that this is because the stretchable portion stretched in accordance with the change in foot circumference which occurred when the heel of FIG. 8 was raised.

The sum $\Sigma\Delta D$ of the amounts of change $\Delta D_1$ to $\Delta D_6$ (the total amount of absolute values of the amounts of change $\Delta D$) of the reference example is larger than those $\Sigma\Delta D$ of the test examples. It is considered that this is because when the heel of the foot is raised, the extensor hallucis longus muscle tendon present in the area corresponding to the distances $D_3$ to $D_6$, the navicular bone, and the medial, middle, and lateral cuneiform bones project forward from the instep, thereby extending the distances $D_3$ to $D_6$, and shortening the distance $D_2$ in the vicinity of the MP joint due to the extension of the distances $D_3$ to $D_6$.

On the other hand, in the reference example, the amount of change when the heel is raised by 80 mm to 100 mm is largest for the distance $D_3$, among the amounts of change $\Delta D_1$ to $\Delta D_6$. While the inter-eyelet distances $D_1$ and $D_2$ on the front side of the second eyelet H$\mathbf{2}_3$ tend to change in the negative direction, the inter-eyelet distances $D_4$ to $D_6$ on the rear side of the second eyelet H$\mathbf{2}_3$ strongly tend to change in the positive direction. Thus, it is presumed that the second eyelet H2 is most preferably provided in the area of the second eyelet $H2_3$ of FIG. 1, i.e., the area of the shafts of the first to fifth metatarsal bones.

It can be seen that the sum ΣΔD of the amounts of change for Test Examples 1 to 3 shown in FIGS. 21A to 21C where a stretchable portion is used in the pair of side panels is smaller than that ΣΔD of Test Example 4 of FIG. 22A where a stretchable portion is used in the main upper. It can be seen that this phenomenon is particularly pronounced for amounts of heel raise H between 20 mm and 80 mm.

The reason for this will be discussed.

When the heel is raised as shown in FIG. 8 from the state of FIG. 7, the central portion of the tongue 4 is pushed by the instep, thereby urging the interval between the second eyelets $H2_3$ of FIG. 1 and the interval between the first eyelets $H1_5$ above to expand. Then, not only does the middle portion 55 of the side panel 51 (52) extend along the circumference direction of the foot, but the tip portion 53 of the side panel 51 also moves in the diagonal front-back direction Y. For example, the distances Dy1 and Dy2 between the second eyelet H2 and the adjacent first eyelets H1 of FIG. 7 both change after the flexion, as can be seen from the comparison between FIG. 7 and FIG. 8. That is, Dy2 is shortened and Dy1 is increased upon flexion.

Thus, as the tip portion 53 of the side panel moves in the diagonal front-back direction Y, the distance from the second eyelet H2 of FIG. 1 to the next first eyelet $H1_2$ and the next first eyelet $H1_4$ changes. It is presumed that the change in the distance $D_i$ between the first eyelets $H1_i$ is also decreased due to the change in the distance in the diagonal front-back direction Y.

It is presumed that another reason why the sum ΣΔD of the amounts of change in Test Example 1, 2 or 3 is smaller than the sum ΣΔD of amounts of change of Test Example 4 is that the second eyelets are provided at two locations in Test Examples 1 to 3 whereas the second eyelet is provided at only one location in Test Example 4.

The sum ΣΔD of amounts of change of Test Example 1 where the side panels are provided so as to be in contact with the medial and lateral side surfaces of the foot is smaller than the sum ΣΔD of amounts of change of Test Examples 2 and 3 where the side panels are provided in the bags of the upper. It is presumed that the reason is that the side panel of Test Example 1 more easily moves in the front-back direction than the side panel in the bag of Test Example 2, and the side panel can immediately deform in response to a change in the shape of the foot.

Next, tests conducted for the preferred number and positions of the second eyelets will be shown.

Figure 26A:
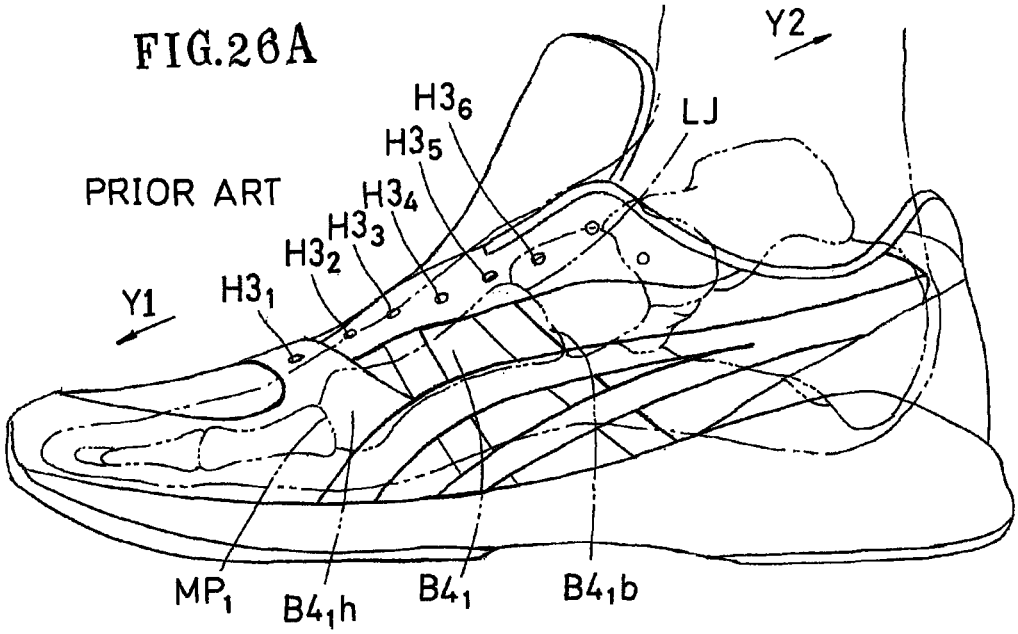
FIGS. 26A and 26B are a medial side view and a lateral side view, respectively, showing the positional relationship between the eyelets and the foot bone structure for the shoe used in Test Examples 11 to 17.

First, Test Examples 11 to 17 to be shown below were provided, which all use the athletic shoes shown in FIGS. 26A and 26B but are different from one another only in the shoelace. In the shoe of FIG. 26A, the positions of the eyelets $H3_1$ and $H3_2$ correspond to the positions of the first eyelets $H1_1$ and $H1_2$ of the shoe of FIG. 3, and the positions of the eyelets $H3_5$ and $H3_6$ of FIG. 26A correspond to the positions of the first eyelets $H1_4$ and $H1_5$ of FIG. 3. The position of the second eyelet $H2_3$ of FIG. 3 corresponds to the position between the eyelets $H3_3$ and $H3_4$ of FIG. 26A. The number of eyelets was set to six so as to match with the aforementioned tests.

FIGS. 23A to 23G are conceptual plan views showing shoelaces used in Test Examples 11 to 17. In these plan views, the eyelets $H3_1$ to $H3_6$ are all first eyelets, and each pair of the eyelets $H3_1$ to $H3_6$ were fastened using an ordinary non-stretchable shoelace 31 or a stretchable rubber-thread-like stretchable shoelace 32. In the figure, a thick line denotes an ordinary non-stretchable shoelace 31, and a thin line denotes a rubber-thread-like stretchable shoelace 32.

For example, in Test Example 11, only the first eyelets $H3_3$ to $H3_3$ were fastened with the stretchable shoelace 32, while the first eyelets $H3_1$ to $H3_2$ were fastened with a non-stretchable shoelace and the first eyelets $H3_4$ to $H3_6$ with another non-stretchable shoelace. The stretch of the stretchable shoelace 32 was set to about 15% or less.

The stretchable shoelace 32 allows the gap between first eyelets to expand, and it is therefore assumed that the area of first eyelets connected together with the stretchable shoelace 32 will have a similar behavior to that where second eyelets are provided. Based on such an assumption, the following tests were conducted.

A sensual test was conducted, in which four test subjects wore each of the shoes of Test Examples 11 to 17 to examine whether the foot is stably held by the shoe when raising the heel of the foot.

As the results of this sensual test, evaluation scores were calculated for each of Test Examples 11 to 16 by the well-known pairwise comparison (AHP) method. The calculation results are shown in the bar graph of FIG. 24.

Figure 24:
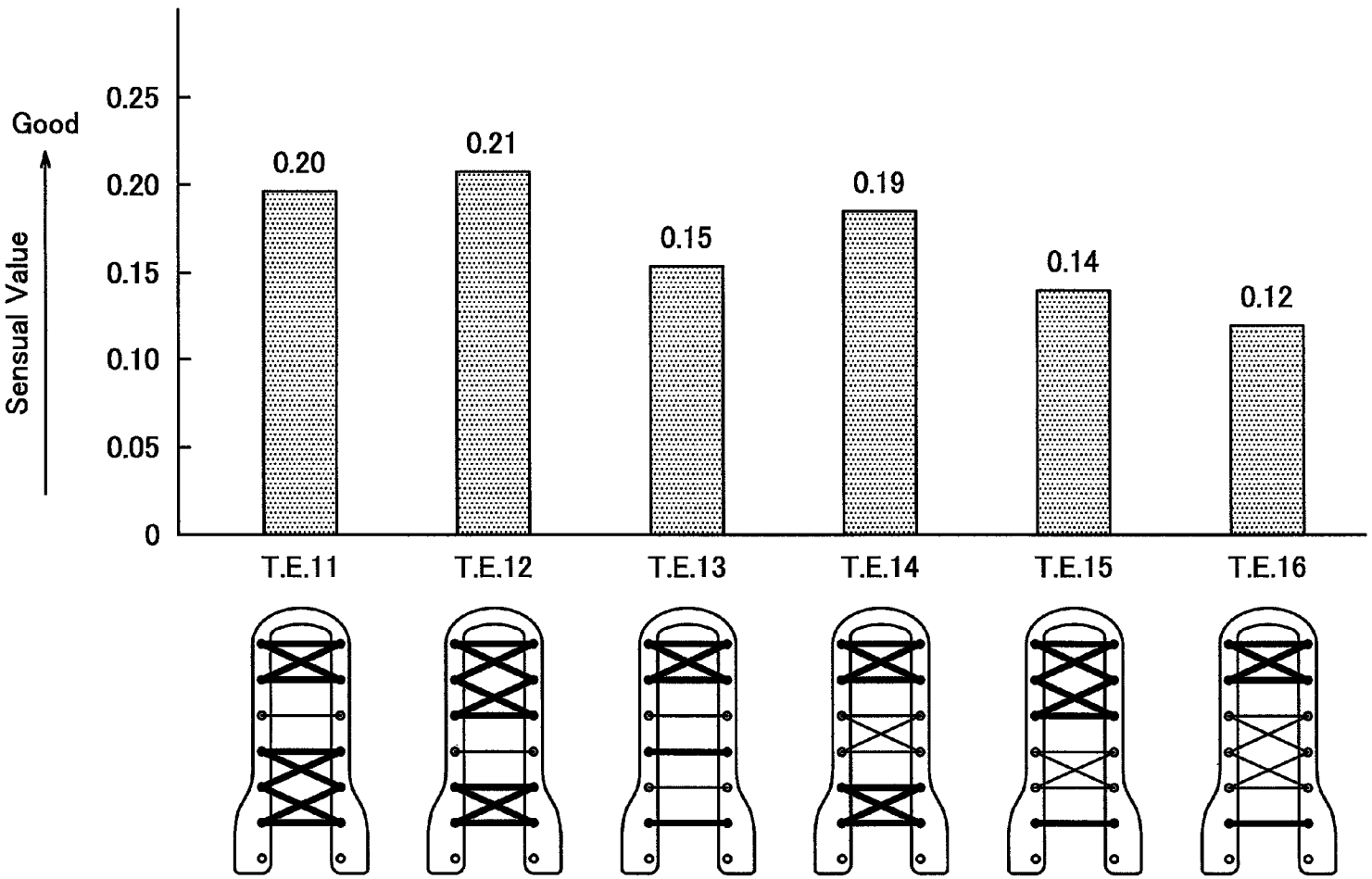
FIG. 24 is a graph showing the results of a sensual test.

As can be seen from the graph of FIG. 24, the foot can be stably held in Test Examples 11, 12 and 14 exhibiting high evaluation scores, where the stretchable shoelace 32 is provided only on the eyelets $H3_3$ and/or $H3_4$. The evaluation score is higher when the stretchable shoelace 32 is provided on one of the eyelets $3_3$ and $3_4$, as compared with a case where it is provided on both of the eyelets $3_3$ and $3_4$. Thus, it will be possible to more stably support the foot when one, rather than two, of the second eyelets H2 is provided on each side.

On the other hand, Test Examples 13, 15 and 16 where the stretchable shoelace 32 is provided on the eyelets $H3_5$ exhibit lower scores, indicating that the foot cannot be held stably.

It can be seen that the holding of the foot is unstable particularly when the stretchable shoelace 32 is provided across the three eyelets $H3_3$ to $H3_5$.

Next, the distances $D_1$ to $D_6$ were measured as in Test Examples 1 to 4 described above, while markers were attached to the vicinity of the eyelets of the shoes of Test Examples 11, 12, 17 and 16 and the shoes were worn on feet. The results are shown in FIGS. 25A to 25D.

The results will be discussed below.

As can be seen from the graphs of FIGS. 25A to 25D, Test Examples 11 and 12 where the stretchable shoelace 32 was provided on the eyelets $H3_3$ or $H3_4$ showed smaller changes in the inter-eyelet distances $D_4$ to $D_6$ as compared with those of Test Examples 17 and 16 where the stretchable shoelace 32 was provided on the eyelets $H3_5$.

Particularly, Test Example 11 where only the eyelets $H3_3$ were fastened with the stretchable shoelace 32 showed small changes in the inter-eyelet distances $D_1$ to $D_6$.

Figure 26B:
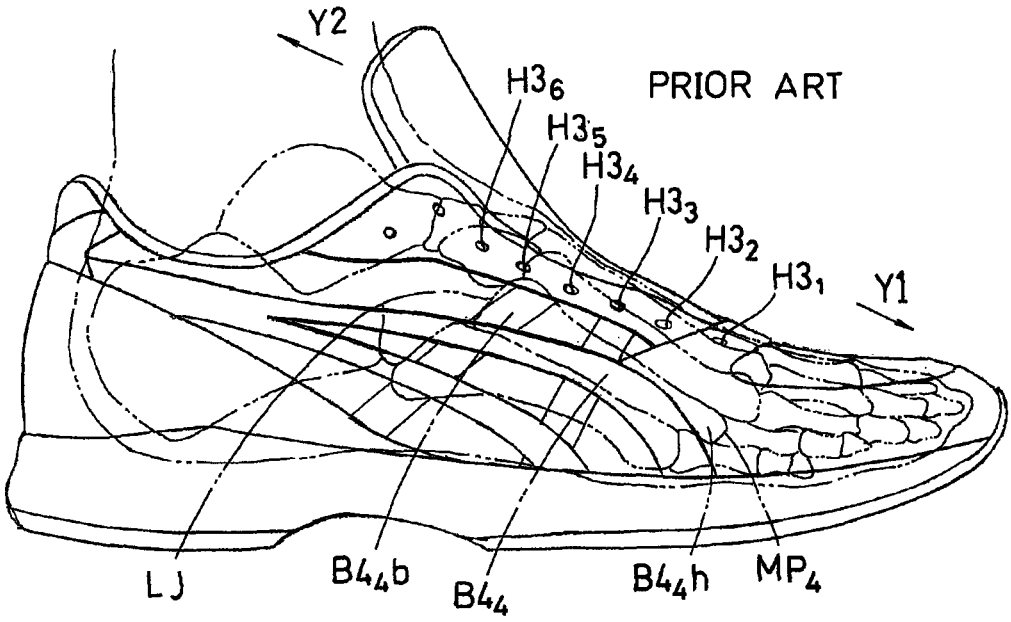

Now, observing the positions, relative to the foot bone structure, of the eyelets $H3_1$ to $H3_6$ of the upper 2 shown in FIGS. 26A and 26B used in Test Examples 11 to 17 shows that the eyelets $H3_3$ and $H3_4$ are arranged at positions posterior Y2 to the metatarsal phalangeal joint MP1 of the first toe and anterior Y1 to the base $B4_1B$ of the metatarsal bone of the first toe on the medial side of the foot while being arranged at positions posterior Y2 to the metatarsal phalangeal joint MP4 of the fourth toe and anterior Y1 to the base $B4_4b$ of the metatarsal bone of the fourth toe on the lateral side.

Therefore, it is presumed that the stable holding of the foot and the fitness property in response to changes in the foot circumference are maximized when the second eyelets H2 are provided only in these areas.

Figure 23A:
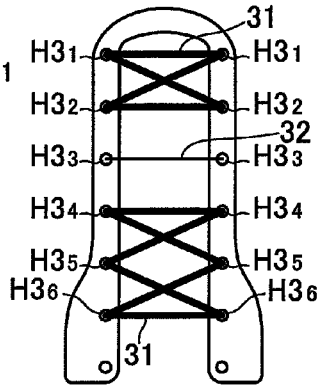
FIGS. 23A, 23B, 23C, 23D, 23E, 23F and 23G are plan views showing an area corresponding to the second eyelet of Test Examples 11, 12, 13, 14, 15, 16 and 17, respectively.
Figure 23B:
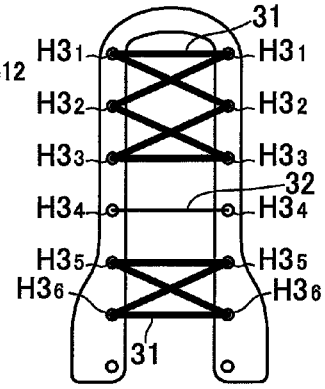
Figure 23C:
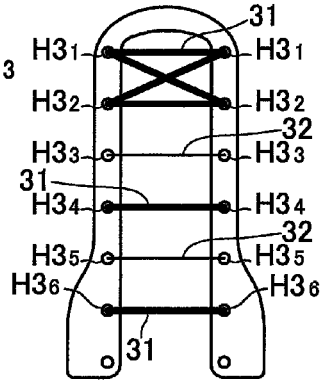
Figure 23D:
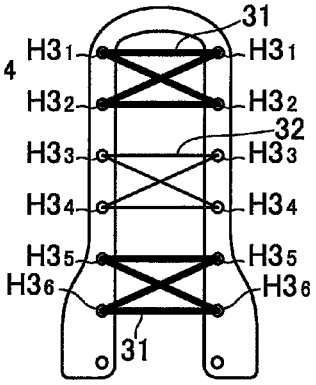
Figure 23E:
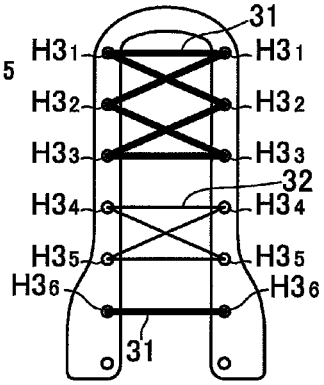
Figure 23F:
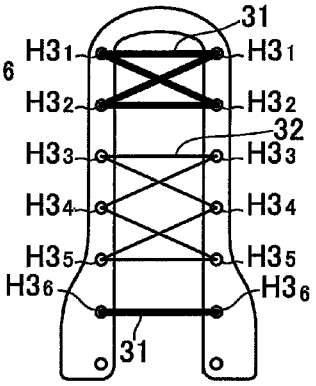
Figure 23G:
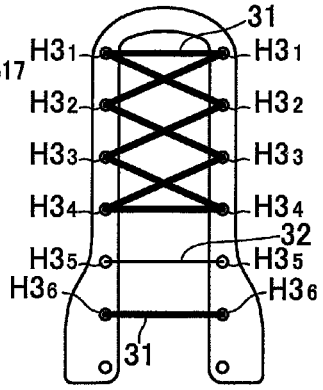
Figure 25A:
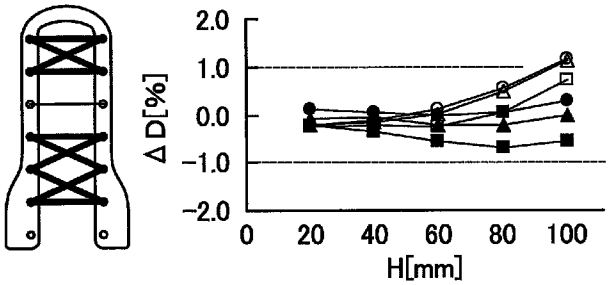
FIGS. 25A, 25B, 25C and 25D are graphs showing the relationship between the amount of heel raise H and the amount of change ΔD in the inter-eyelet distance for the shoes of Test Examples 11, 12, 17 and 16, respectively.
Figure 25B:
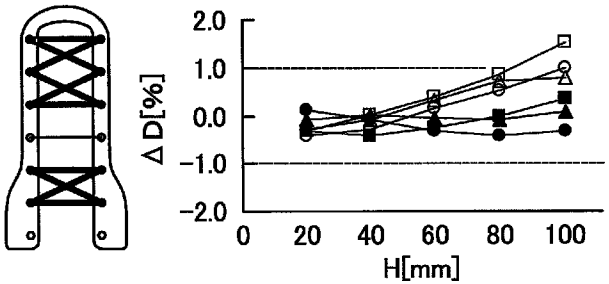
Figure 25C:
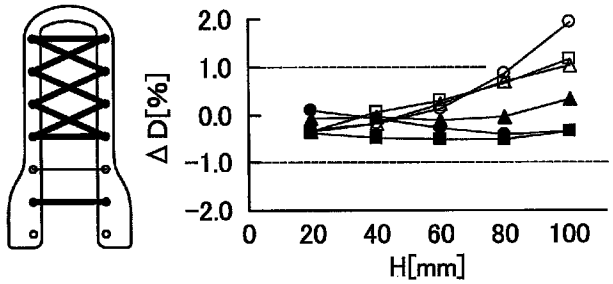
Figure 25D:
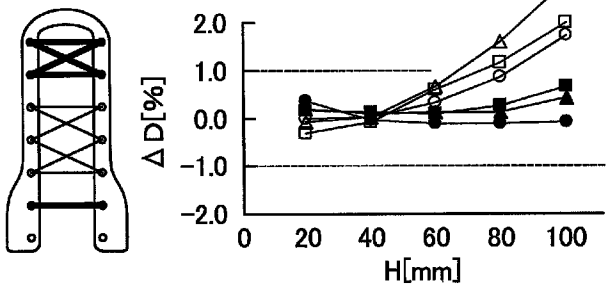

On the other hand, with Test Example 16 where three eyelets $H3_3$ to $H3_5$ are connected together by the stretchable shoelace 32 as shown in FIG. 23F, the expansion of the inter-eyelet distances $D_4$ to $D_6$ is significantly excessive and it is not possible to stably hold the foot, as can be seen from FIGS. 24 and 25D. Therefore, in the sixth patent document (Nakano), it is presumed that the function of stably holding the foot significantly lowers when the side panel is formed by a rubber or a stretchable fabric.

Next, a fifth embodiment will be described with reference to FIGS. 27 to 39.

In this embodiment, the side panels 51 and 52 which are movable portions do not need to have stretchable portions. Before describing the fifth embodiment, advantages of the second eyelets H2 being displaced in the transverse direction X and the diagonal front-back direction Y with respect to the main upper (main portion) 2M via the side panels 51 and 52 will be described.

Figure 27:
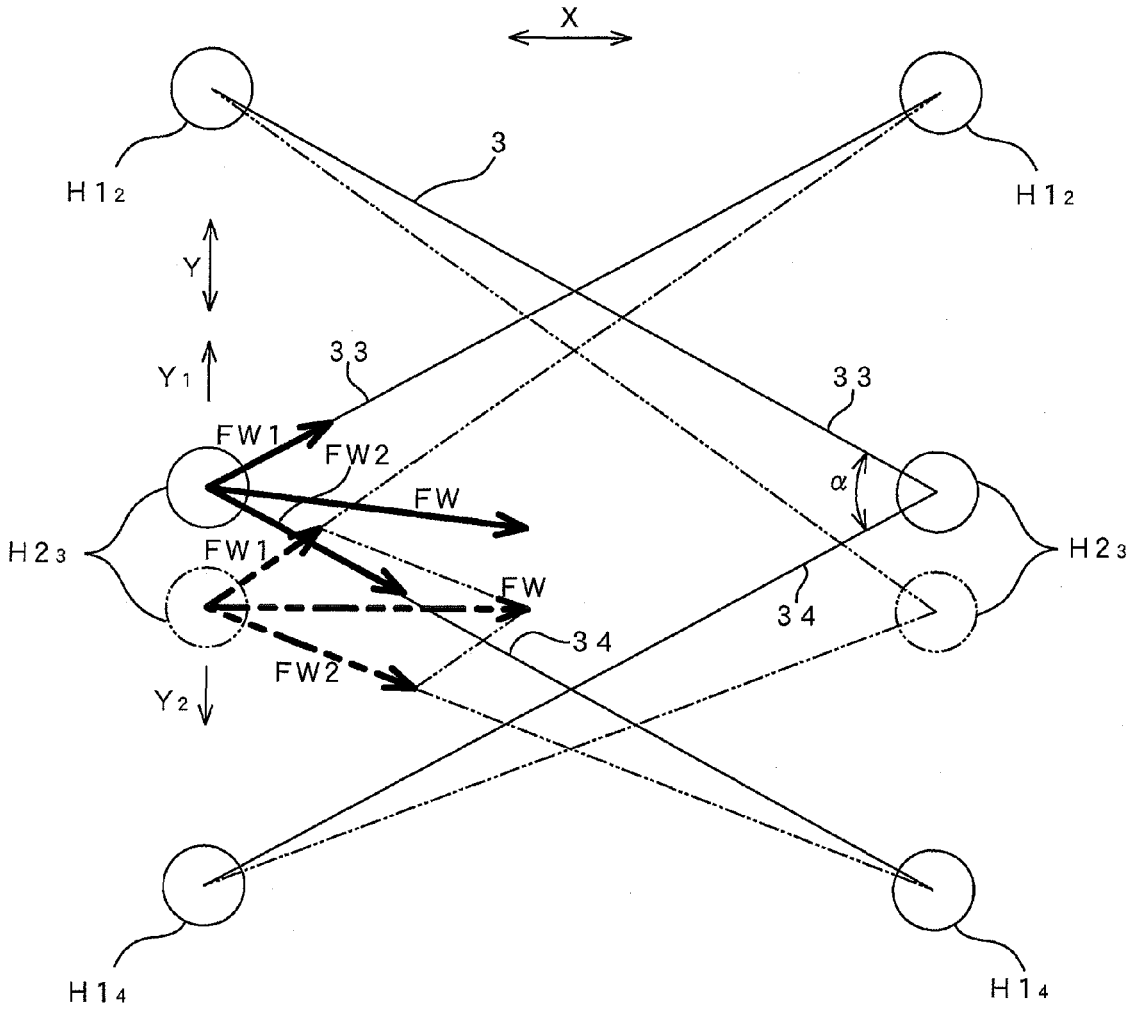
FIG. 27 is a plan view conceptually showing the movement of the eyelets and the shoelaces of the fifth embodiment.

Referring to FIG. 27, the upper 2 in which the second eyelets $H2_3$ are arranged between the front-side first eyelets $H1_2$ and the rear-side first eyelets $H1_4$ will be discussed.

While the foot is moved from the flat-footed position to the heel-raised position in a state where the upper is fastened by the shoelace 3 as shown in a solid line, the second eyelets $H2_3$ are displaced in the diagonal front-back direction Y1/Y2 with respect to the main portion 2M via the movable portions (side panels) 51 and 52 in response to a change in the direction of the resultant force FW between the first tensile force FW1 and the second tensile force FW2 exerted upon the second side edge portion 20B by V-shaped portions 33 and 34 of the shoelace 3 which are engaged with the second eyelets $H2_3$. Thus, the direction of the resultant force FW becomes equal to or comes close to the transverse direction X, and the second eyelets $H2_3$ are displaced to most relaxed positions. In this process, as the second eyelets $H2_3$ are displaced in the diagonal front-back direction Y, the tensile forces FW1 and FW2 will change, e.g., with the first tensile force FW1 slightly increasing and the second tensile force FW2 slightly decreasing.

On the other hand, as the second eyelets $H2_3$ are displaced in the transverse direction X, the distance between diagonally-opposing eyelets varies. Therefore, by the displacement of the second eyelets $H2_3$ in the transverse direction X, it is possible to reduce the change in the tension on the shoelace 3 due to variations in the distance between diagonally-opposing eyelets.

The fifth embodiment is directed to a structure with which the second eyelets $H2_3$ provided on the side panels 51 and 52 are movable in the transverse direction X and the diagonal front-back direction Y even though the side panels 51 and 52 of FIGS. 28 to 39 do not stretch.

In the fifth embodiment, like elements to those of the first embodiment are denoted by like reference numerals and will not be further described below.

Figure 28:
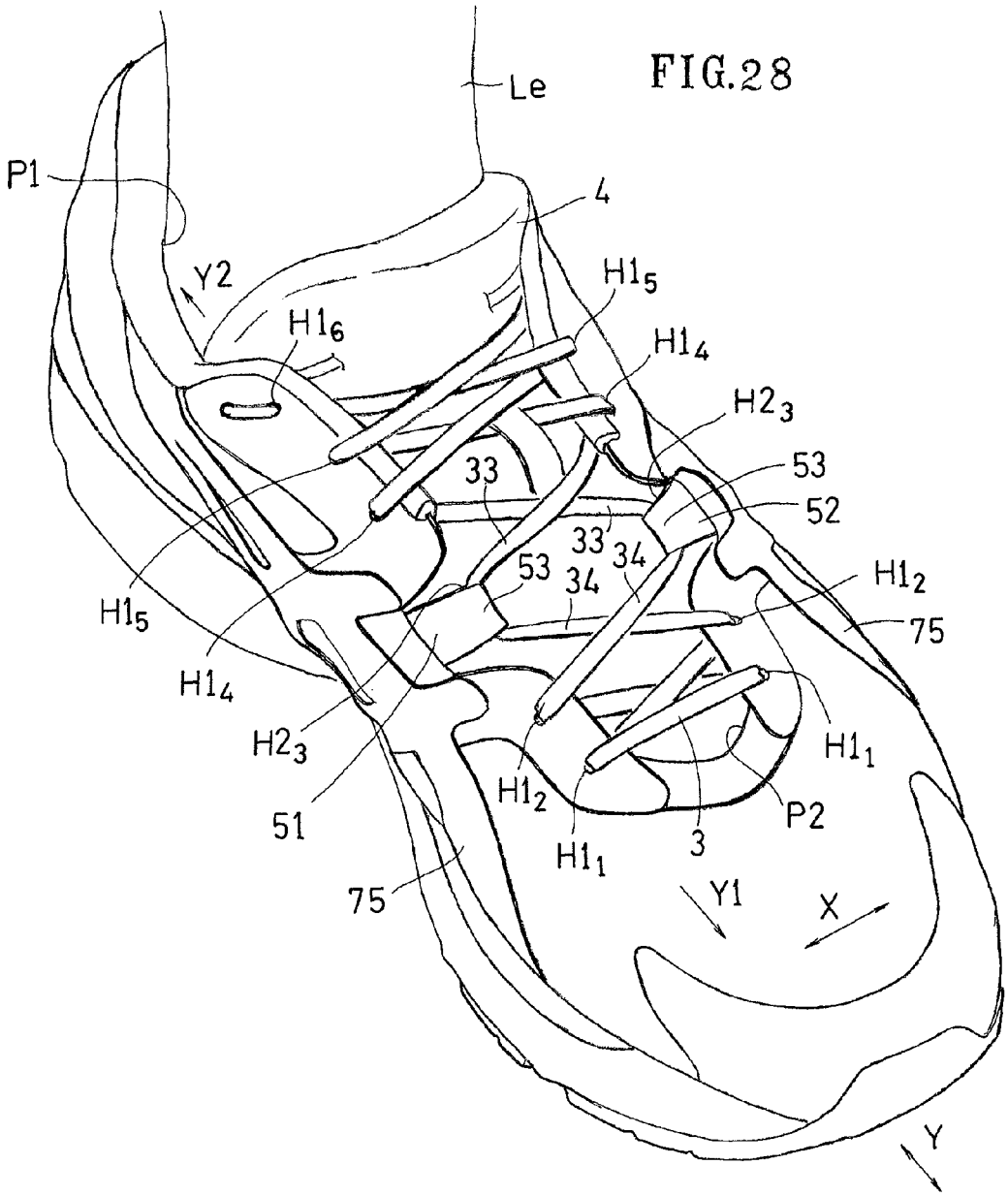
FIG. 28 is a schematic perspective view showing a shoe according to a fifth embodiment of the present invention.
Figure 29:
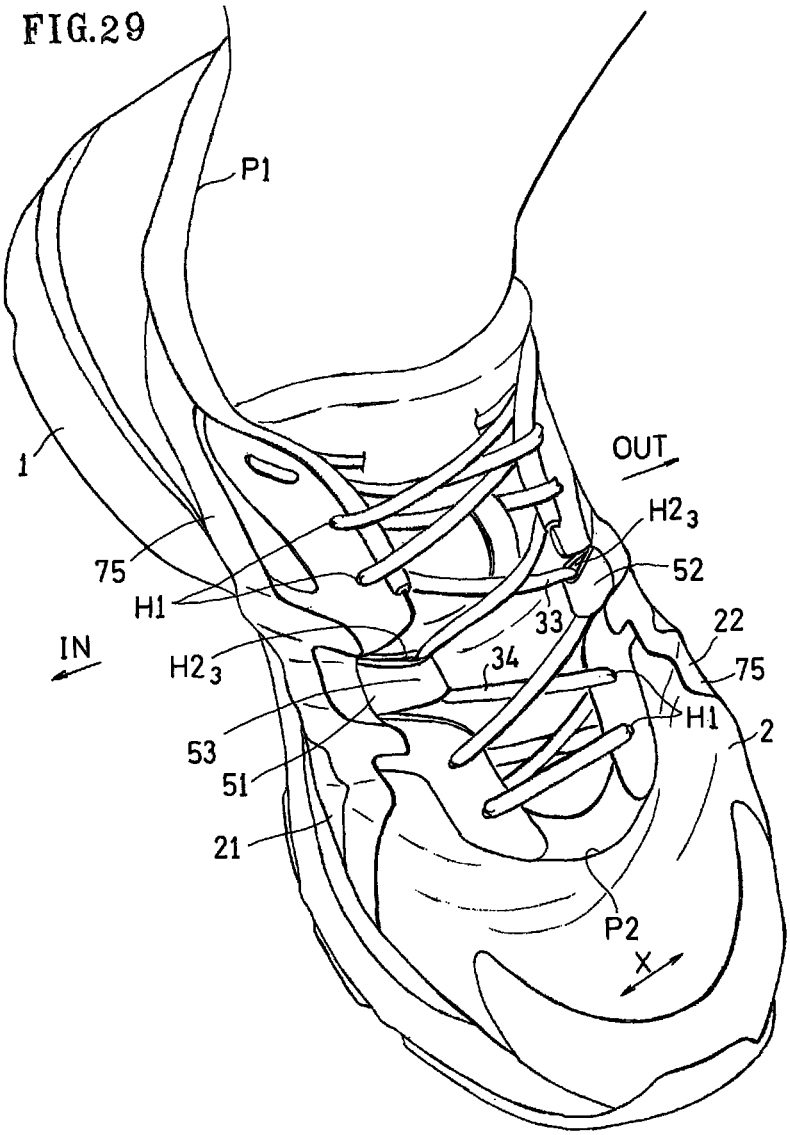
FIG. 29 is a schematic perspective view showing the shoe of the embodiment in a dorsally-flexed state achieved by wearing the shoe and raising the heel.

In the present embodiment, division portions 7 are formed in the main upper 2M by dividing the first side edge portion 20A of FIG. 28 including the first eyelets H1 formed therein into pieces, one on the front side and the other on the rear side of the side panels 51 and 52, with the side panels 51 and 52 arranged in the division portions 7. The division portions 7 extend completely across the medial side surface 21 and the lateral side surface 22, respectively, of the main upper 2M (FIG. 29).

As shown in FIGS. 33 to 36, the first side edge portion 20A is obtained by sewing so-called "ornamental eyelets" to the base fabric.

The width W5 of the side panels 51 and 52 (FIG. 30) tapers in an upward direction, and is smaller than the width W7 of the division portion 7. That is, the front gap ΔS1 or the rear gap ΔS2 are formed between a front edge 73 or a rear edge 74 of the division portion 7 (FIG. 39A) and a front edge 503 or a rear edge 504 of the side panels 51 and 52 (FIG. 39A), the front gap ΔS1 or the rear gap ΔS2 allowing the side panels 51 and 52, which extend in the diagonally rearward and downward direction, to come closer toward the front edge 73 or the rear edge 74 of the division portion 7, whereby the second eyelet $H2_3$ provided in the side panels 51 and 52 can move in the front direction Y1 and the rear direction Y2 of the diagonal front-back direction Y and the transverse direction X.

Figure 39A:
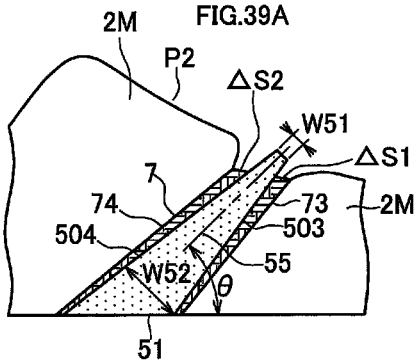
FIGS. 39A and 39B are a medial side view and a lateral side view, respectively, schematically showing the relationship between the division portion and the side panel.
Figure 39B:
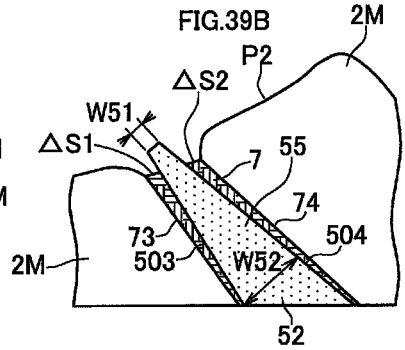
Figure 39C:
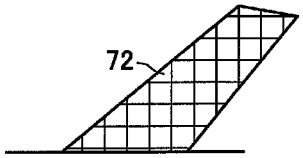
FIGS. 39C and 39D are side views schematically showing how threads of the inner skin and the outer skin are deformed.
Figure 39D:
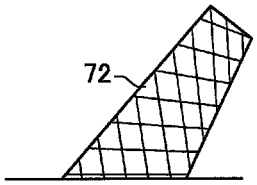

As clearly shown in FIGS. 39A and 39B, the front gap ΔS1 and the rear gap ΔS2 grow larger from the upper surface of the sole 1 toward the second opening P2, and therefore the middle portions 55 of the side panels 51 and 52 can relatively move with respect to the main upper 2M in the front direction Y1 and the rear direction Y2.

Figure 32:
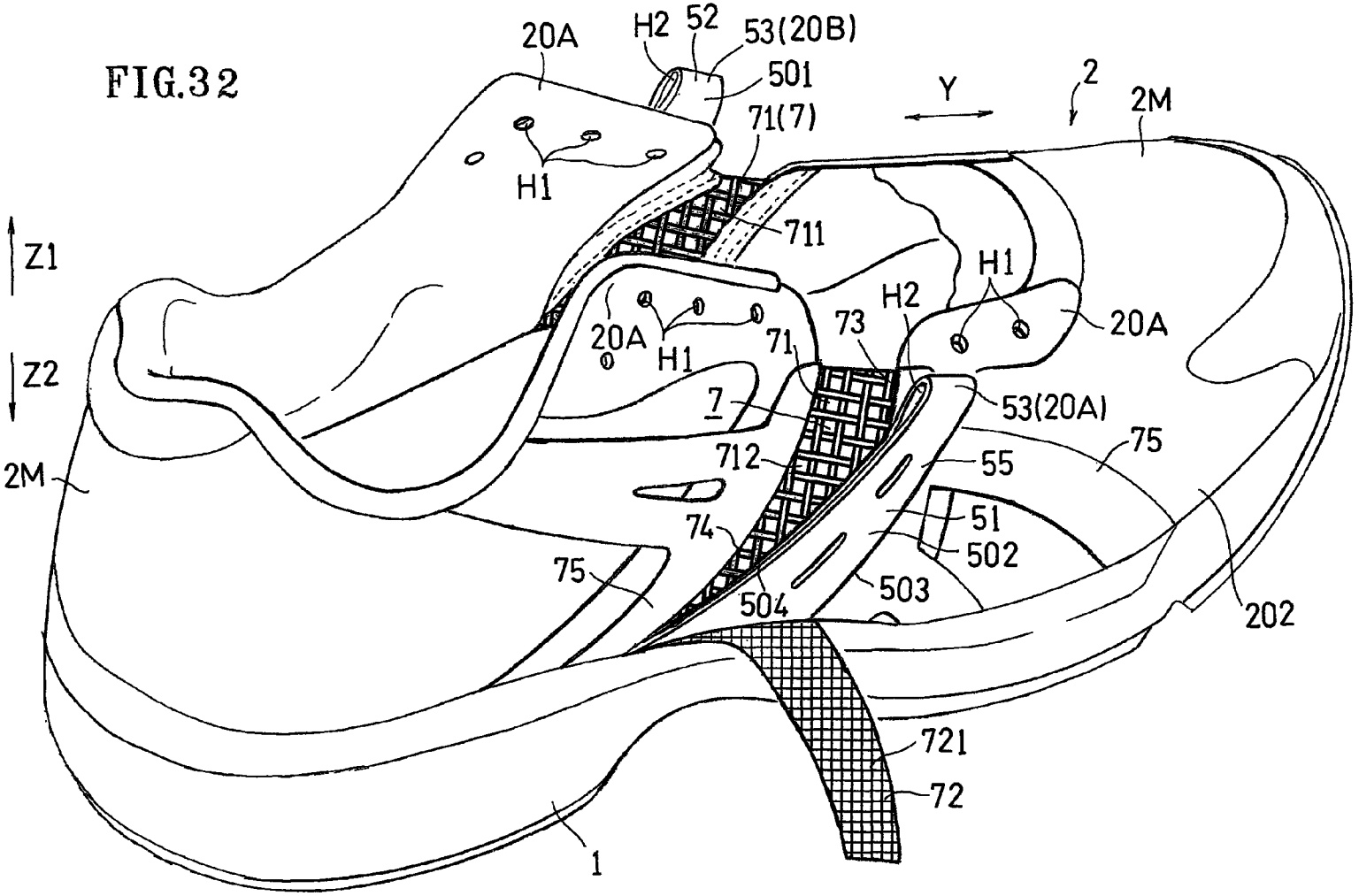
FIG. 32 is a schematic perspective view showing the inside of the shoe of the embodiment as viewed from the medial side of the foot.

In the present embodiment, the division portion 7 is formed by an inner skin 71 and an outer skin 72 as shown in FIG. 32.

Figure 35:
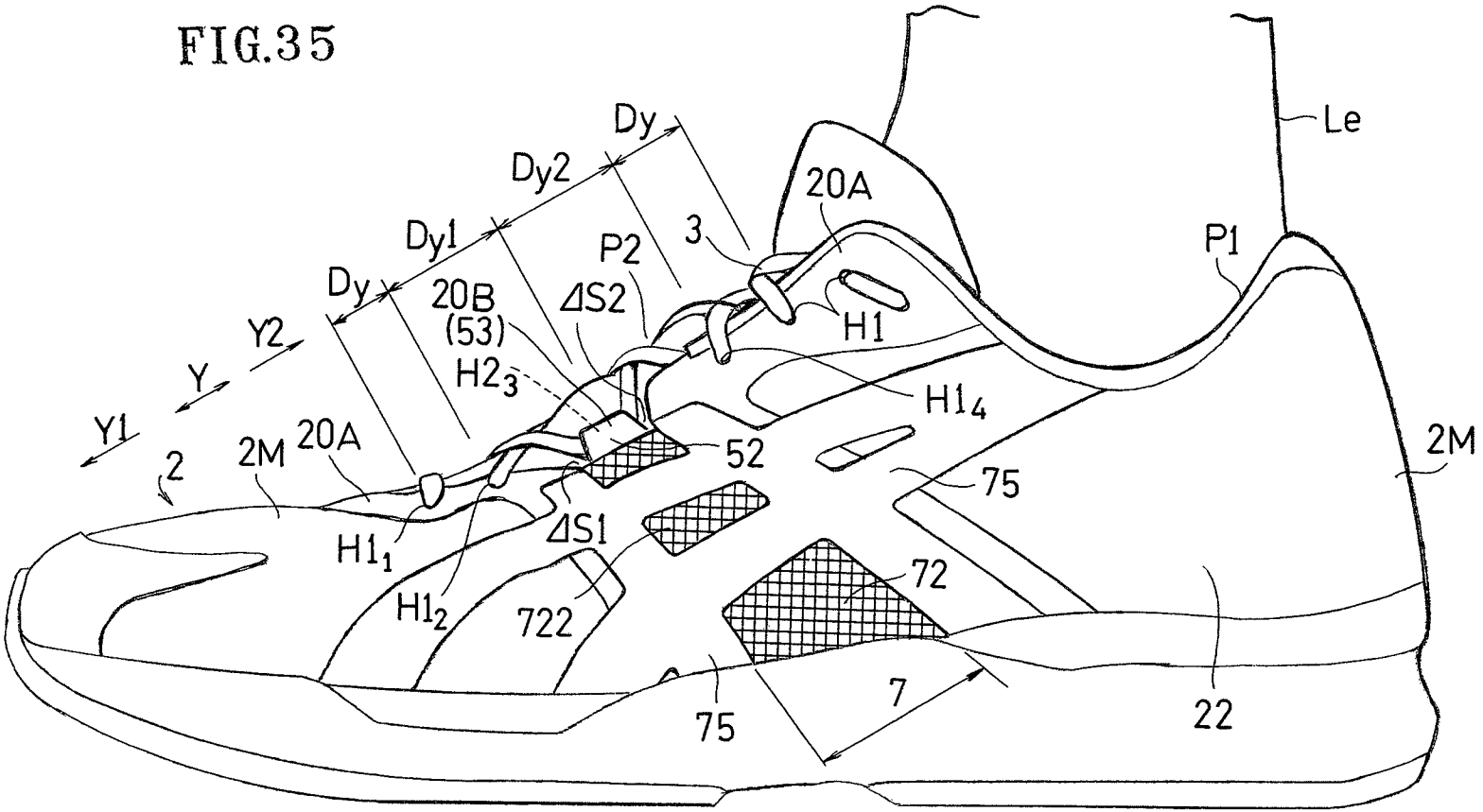
FIG. 35 is a schematic side view showing the shoe of the embodiment in a flat-footed position as viewed from the lateral side of the foot.
Figure 36:
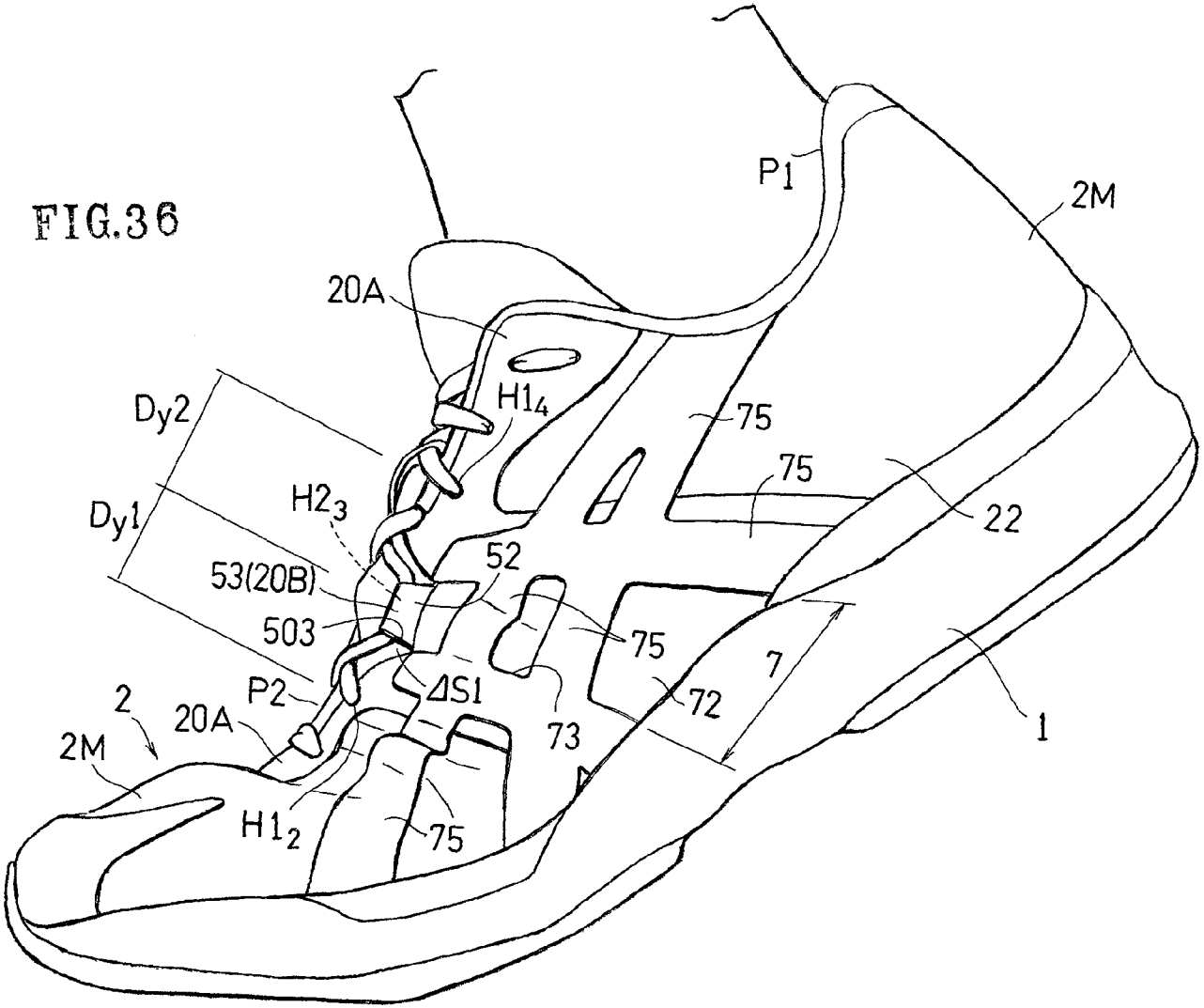
FIG. 36 is a schematic side view showing the shoe of the embodiment in a heel-raised position achieved by wearing the shoe and raising the heel.
Figure 37A:
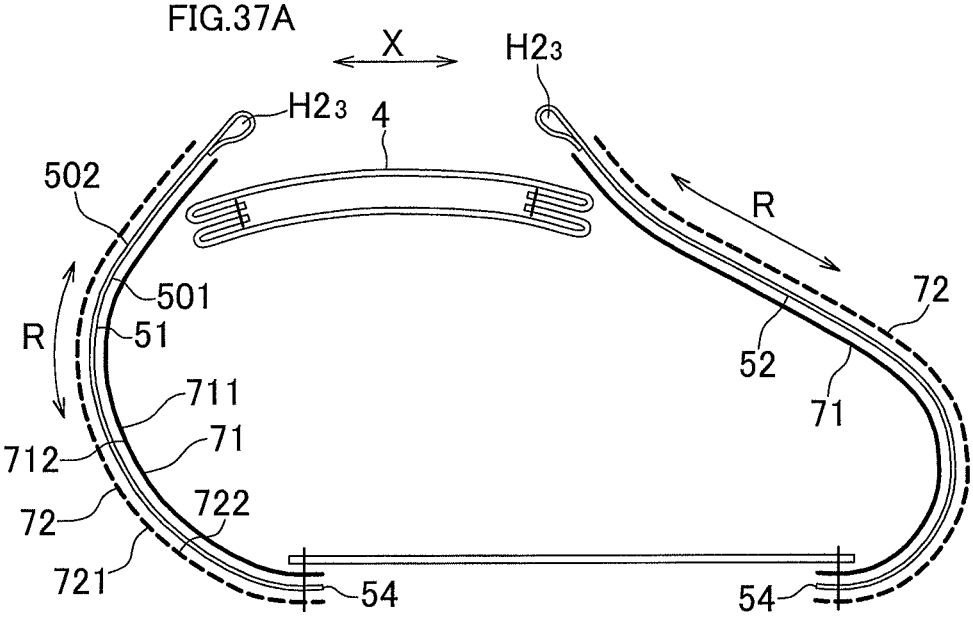
FIG. 37A is a schematic cross-sectional view of the upper obtained cutting the shoe of the embodiment in an area including the division portion.

As can be seen from FIGS. 30 to 36, the inner skin 71 and the outer skin 72 of the division portion 7 and the side panels 51 and 52 extend across the medial side surface 21 and the lateral side surface 22, respectively, of the main upper 2M in the circumference direction R (FIG. 37A). The inner skin 71 and the outer skin 72 are sewn to the main upper 2M in the vicinity of the front edge 73 and the rear edge 74 of the division portion 7.

The essentially non-stretching middle portion 55 and the second side edge portion 20B (the tip portion 53) including the loop-shaped second eyelet $H2_3$ formed therein of the side panels 51 and 52 are attached to the sole 1 only via the bottom portion 54.

Such side panels 51 and 52 are capable of pivoting back and forth about the bottom portion 54 as the center, and therefore the displacement of the second eyelets $H2_3$ can be substantial.

The width of the inner skin 71 and the outer skin 72 tapers in an upward direction from the sole 1. On the other hand, the division portion 7 of the main upper 2M expands in the diagonal front-back direction Y toward the upper side in the upper end portion which faces the second opening 2P. Thus, the displacement of the tip portion 53 of the side panels 51 and 52 with respect to the middle portion 55 can be substantial.

Figure 37B:
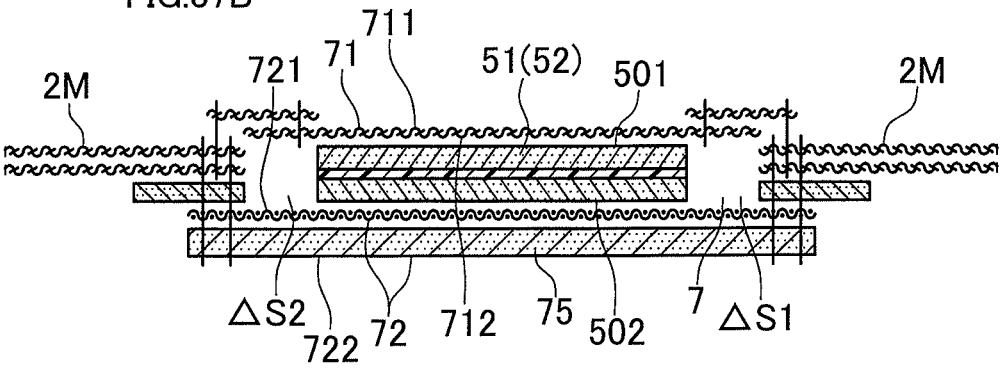
FIG. 37B is a flat cross-sectional view of the upper obtained by cutting the shoe of the embodiment in an area including the division portion.

As clearly shown in FIG. 37B, the division portion 7 is formed in a pocket-like shape by the inner skin 71 and the outer skin 72. The inner skin 71 and the outer skin 72 are spaced apart from each other in the transverse direction X at the front edge 73 and the rear edge 74 of the division portion 7. Thus, the side panels 51 and 52 can be displaced smoothly to the front edge 73 and the rear edge 74.

The inner skin 71 of FIG. 37A is in contact with an inner surface 501 of the side panels 51 and 52, and an inner surface 711 of the inner skin 71 is smoother than an inner surface 201 of the main upper 2M of FIG. 32 which is in contact with the side surface of the foot.

An outer surface 712 of the inner skin 71 which is in contact with the inner surface 501 of the side panels 51 and 52 of FIG. 37A and an inner surface 721 of the outer skin 72 which is in contact with an outer surface 502 of the side panels 51 and 52 are smoother than an outer surface 202 of the main upper 2M of FIG. 32.

Now, "smooth" means that the degree of roughness of the inner surface 711 of the inner skin 71 and the inner surface 721 of the outer skin 72 is smaller than that of the surface to be compared, and herein typically means that the coefficient of friction is small against the side panels 51 and 52 or socks.

As the material forming such a smooth surface, a sheet-like member of a woven fabric or a knit fabric using a yarn of a chemical fiber such as rayon is employed.

Figure 33:
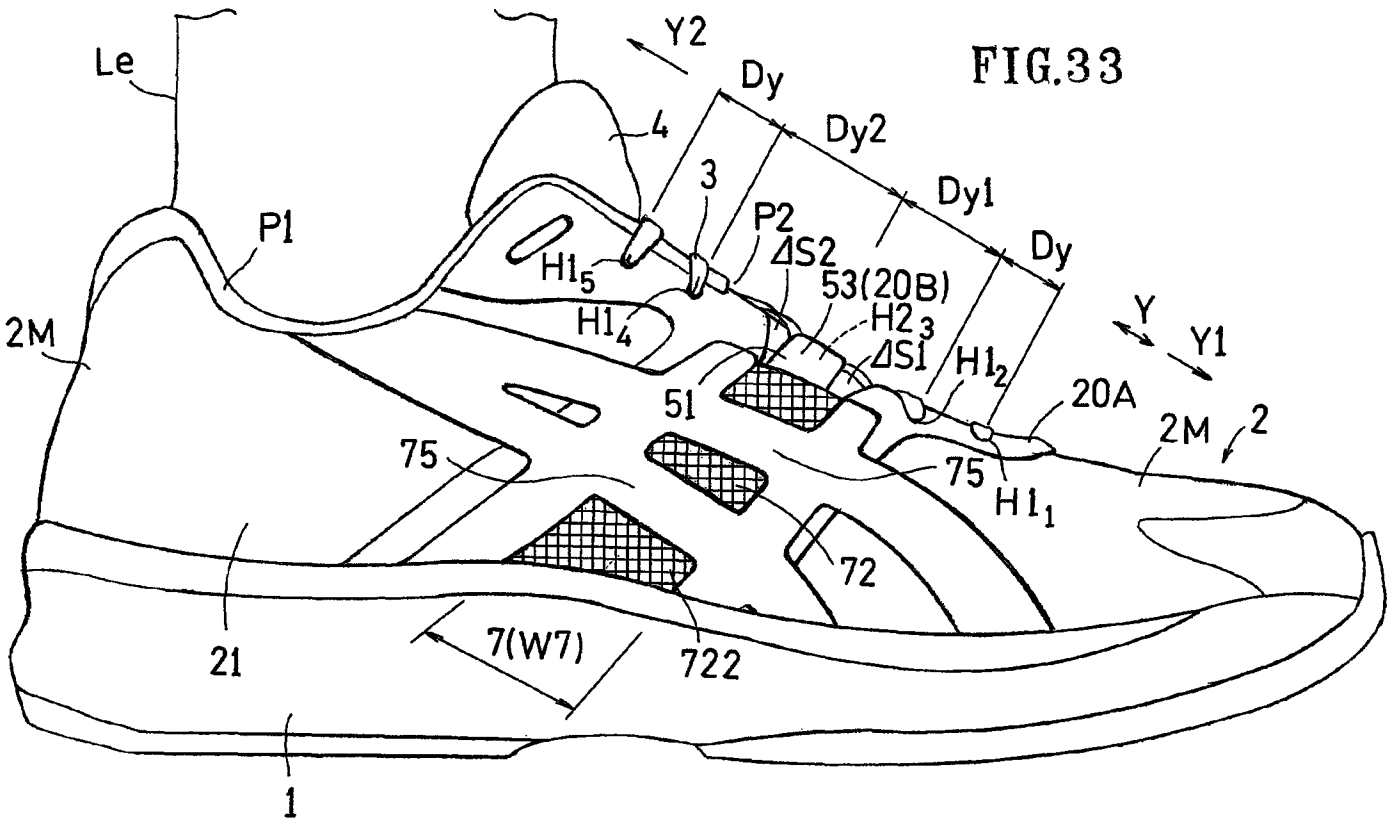
FIG. 33 is a schematic side view showing the shoe of the embodiment in a flat-footed position as viewed from the medial side of the foot.

In the present embodiment, for example, the inner skin 71 of FIG. 32 may be formed as two layers of a woven fabric, whereas the outer skin 72 is obtained by sewing a tape material (soft resin) 75 of FIG. 33 onto the outer surface of a woven fabric. In FIGS. 32, 33 and 35, the inner skin 71 and the outer skin 72 formed by a woven fabric are patterned in a mesh pattern, etc.

The inner skin 71 and the outer skin 72 forming the division portion 7 are thinner, and have a smaller flexural rigidity, than the member forming the main upper 2M on the front side and the rear side of the division portion 7.

Figure 39E:
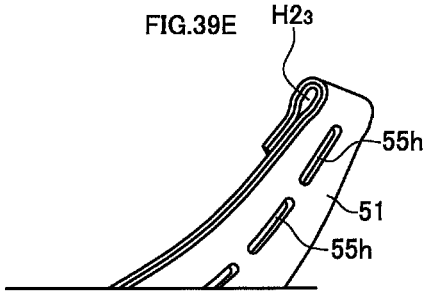
FIG. 39E is a perspective view showing an example of the side panel.

The flexural rigidity of the member forming the side panels 51 and 52 is greater than the flexural rigidity of the inner skin 71 and the outer skin 72 of the division portion 7. The side panels 51 and 52 may be formed by, for example, attaching together two layers of synthetic leather as shown in FIGS. 37B and 39E, in which case the side panels 51 and 52 may exhibit stretchability if the through holes 55*h* are formed only in one of the two layers of synthetic leather.

Now, the "flexural rigidity" for the sheet-like member is defined as the product between the Young's modulus of the member forming the division portion 7 or the side panels 51 and 52 and the thickness thereof cubed.

As another method for measuring the "flexural rigidity", each cut-out member may be folded in two so that the front edge and the rear edge overlap with each other, and the flexural rigidity can be known as the magnitude of the load that is required for the folding.

The inner skin 71 and/or the outer skin 72 may be formed by the stretchable member described above, instead of having a small flexural rigidity. This is because such a sheet-like member follows the flexion of the foot.

Since the tape material 75 is sewn to the outer skin 72, the inner skin 71 has a smaller flexural rigidity, and is thinner, than the outer skin 72. The thin and flexible inner skin 71 easily deforms as shown in FIGS. 38A to 38F, and gives no stiff feel after being deformed. Therefore, it is capable of deforming even in a small, narrow space between the side panels 51 and 52 and the side surfaces of the foot.

On the other hand, the outer skin 72 with the tape material 75 sewn thereto has a greater flexural rigidity and a greater thickness than the inner skin 71, and is curved so as to be bulged toward the outside (outwardly) of the upper 2 as shown in FIGS. 29 and 36. This allows the deformation of the division portion 7 shown in FIGS. 38A to 38C.

The outer skin 72 may have a greater thickness than the side panels 51 and 52 as long as the flexural rigidity thereof is smaller than the side panels 51 and 52.

The outer skin 72 with the tape material 75 sewn thereto has a greater tensile rigidity in the front-back direction than the inner skin 71. The great tensile rigidity of the outer skin 72 serves as the resistance force when the upper 2 is pulled in the front-back direction in the division portion 7.

The tape material is sewn across the outer skin 72 and the main upper 2M on the front side and the rear side thereof.

The woven fabric forming the inner skin 71 and the outer skin 72 shown in FIG. 32 has its yarn extending in the front-back direction and the up-down direction Z1/Z2. Therefore, the inner skin 71 and the outer skin 72 are less stretchable in the front-back direction, and is more stretchable in a diagonal direction crossing the front-back direction and the up-down direction Z1/Z2. Such a yarn direction will unlikely prevent the division portion 7 from changing its shape from that of FIG. 39C to that of FIG. 39D.

Figure 30:
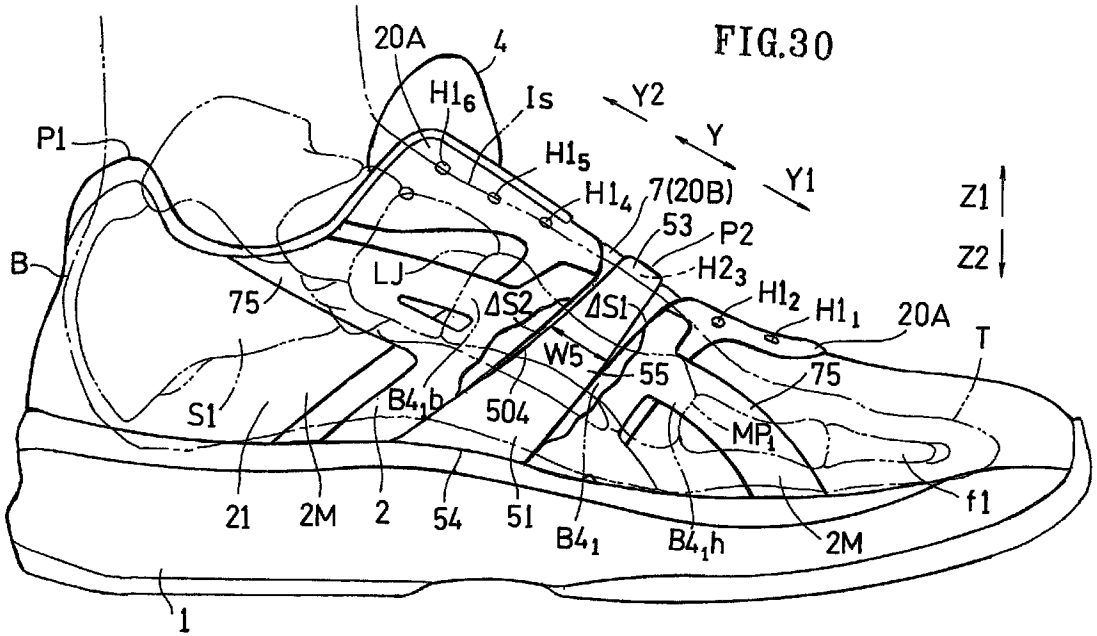
FIG. 30 is a partially-broken schematic side view showing the relationship between the shoe of the embodiment and the foot bone structure as viewed from the medial side of the foot.
Figure 31:
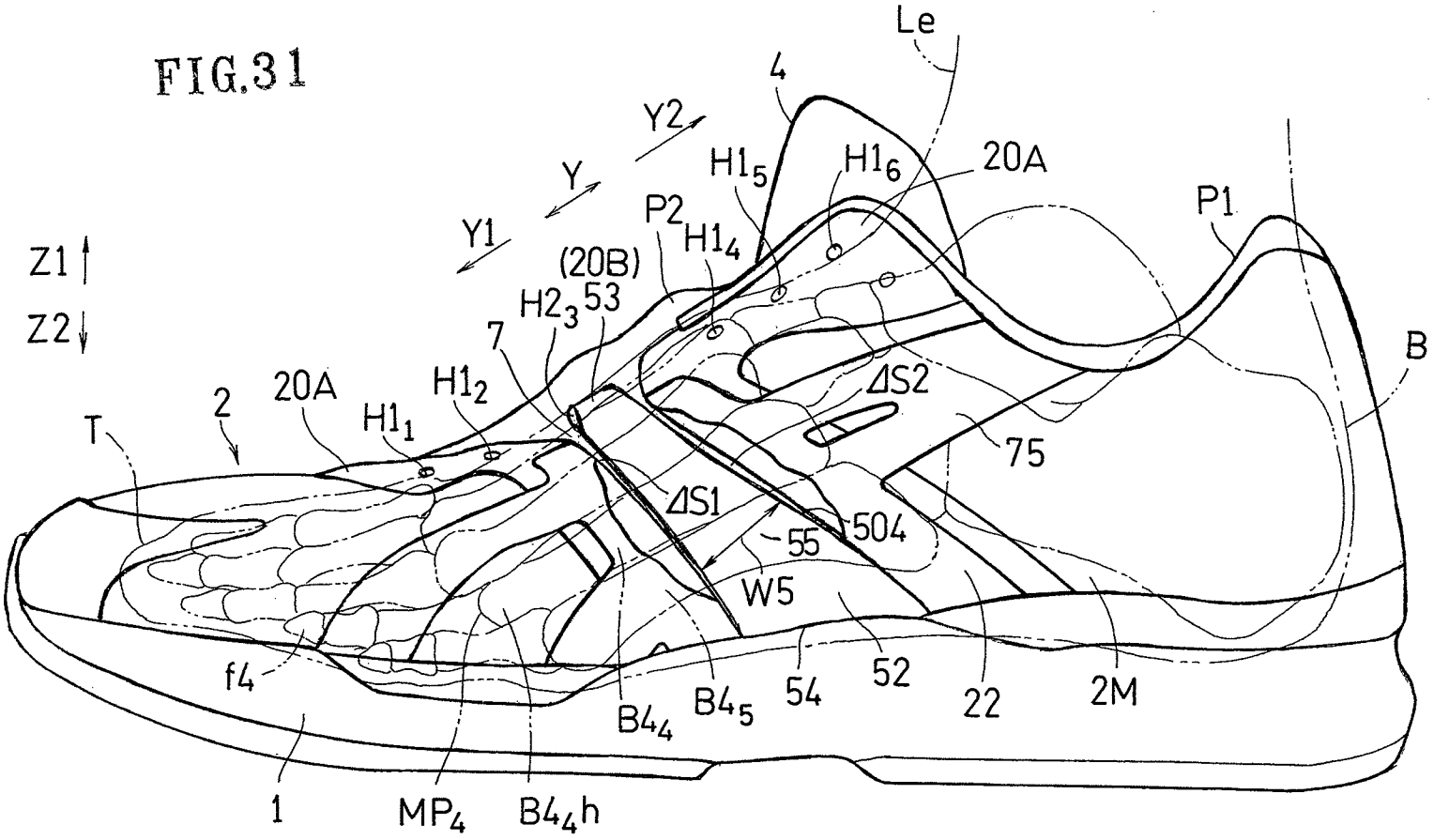
FIG. 31 is a partially-broken schematic side view showing the relationship between the shoe of the embodiment and the foot bone structure as viewed from the lateral side of the foot.

In FIGS. 30 and 31, the side panels 51 and 52 and the division portion 7 taper in a diagonal direction which slopes up in the front direction, and extend from the upper surface of the sole 1 to the second opening P2. The angle θ between the side panels 51 and 52 and the division portion 7 and the upper surface of the sole 1 is set to be about 40° to 55°, and the rear end of the tip portion 53 is arranged anterior (Y1) to the front end of the bottom portion 54. Therefore, when the second tensile force FW2 of FIG. 27 increases, the rear edge 504 of the side panels 51 and 52 pivots about the bottom portion 54 as the center so as to come closer to the rear edge of the division portion 7.

Thus, in order for the side panels 51 and 52 to pivot, it is preferred that the width W5 of the side panels 51 and 52 in the diagonal front-back direction Y is small.

The width W5 of the side panels 51 and 52 is preferably 5 mm to 20 mm at the tip W51 and about 15 mm to 35 mm at the bottom W52, and is more preferably 7 mm to 17 mm at the tip W51 and about 20 mm to 30 mm at the bottom W52.

If the width of the width W5 is too small, the fastening force of the shoelace 3 acting upon the side surfaces of the foot via the side panels 51 and 52 may become too strong.

As shown in FIGS. 33 and 35, the second distance Dy1 between the second eyelet $H2_3$ and the first eyelet $H1_2$ on the front side of the second eyelet $H2_3$ is greater than the first distance Dy between first eyelets H1 that are adjacent to each other in the diagonal front-back direction Y, and the third distance Dy2 between the second eyelet $H2_3$ and the first eyelet $H1_4$ on the rear side of the second eyelet $H2_3$ is greater than the first distance Dy.

In this case, the angle α between the V-shaped portions 33 and 34 of the shoelace 3 of FIG. 27 is relatively large. Therefore, the second eyelets $H2_3$ are easily displaced in the diagonal front-back direction Y by a change in the first or second tensile force FW1 or FW2.

Figure 40:
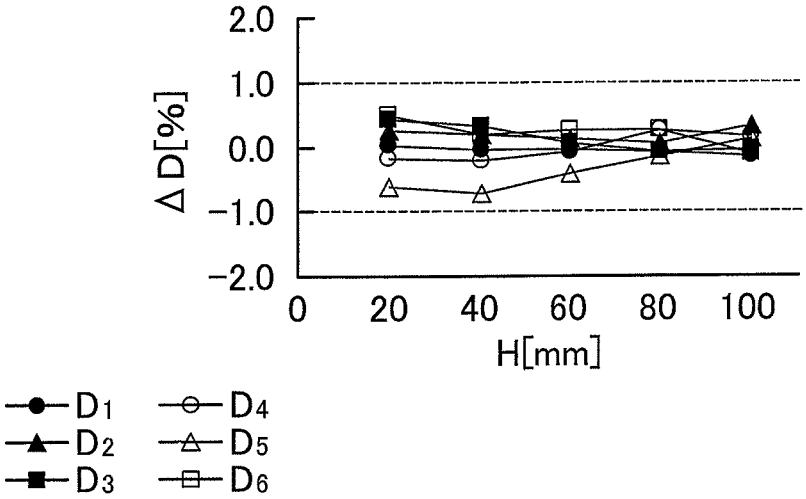
FIG. 40 is a graph showing the relationship between the amount of heel raise H and the amount of change ΔD in the inter-eyelet distance for a shoe of Test Example 20.

Next, a test similar to Test Examples 1 to 4 described above was conducted using shoes of the present embodiment as Test Example 5. The results are shown in the graph of FIG. 40.

It can be seen that in Test Example 5, the sum ΣΔD of the amounts of change $\Delta D_1$ to $\Delta D_6$ of all the inter-eyelet distances $D_1$ to $D_6$ is further smaller than those of Test Examples 1 to 4 of FIGS. 21A to 21C and 22A.

Particularly, the amounts of change $\Delta D_4$ to $\Delta D_6$ for the first eyelets $H1_4$ to $H1_6$ posterior to the second eyelets $H2_3$ are small, with the amounts of changes $\Delta D_4$ and $\Delta D_5$ even transitioning into the negative side.

That is, the inter-eyelet distances $D_3$ to $D_6$ are unlikely to be large, and therefore the fitness property is high at the opening (the first opening P1).

The reason for this will now be discussed, together with the upper 2 in a case where a shoe of the present embodiment is worn.

First, the deformation of the upper 2 when transitioning from the state of the flat-footed position of FIGS. 28, 33 and 35 (a state where the toe and the heel of the sole 1 are on the ground) to the heel-raised position FIGS. 29, 34 and 36 (a state where the toe of the sole 1 is on the ground with the heel raised upward off the ground) will be described.

While transitioning from the state of the flat-footed position of FIG. 38A to the heel-raised position of FIGS. 38B and 38C, the MP joint is dorsally-flexed, thereby contracting the upper edge (top) of the upper 2 into a C-letter shape, thus deforming the division portion 7.

If the rigidity of the division portion 7 is large, the first opening P1 and the second opening P2 of FIG. 29 will expand in the transverse direction as the upper edge of the upper 2 is urged to contract.

In contrast, the upper 2 of the present embodiment (Test Example 5) includes the flexible division portion 7 in the middle foot portion. Therefore, the upper 2 easily deforms in response to dorsal flexion of the MP joint, thereby preventing the distances $D_3$ to $D_6$ from increasing.

Figure 34:
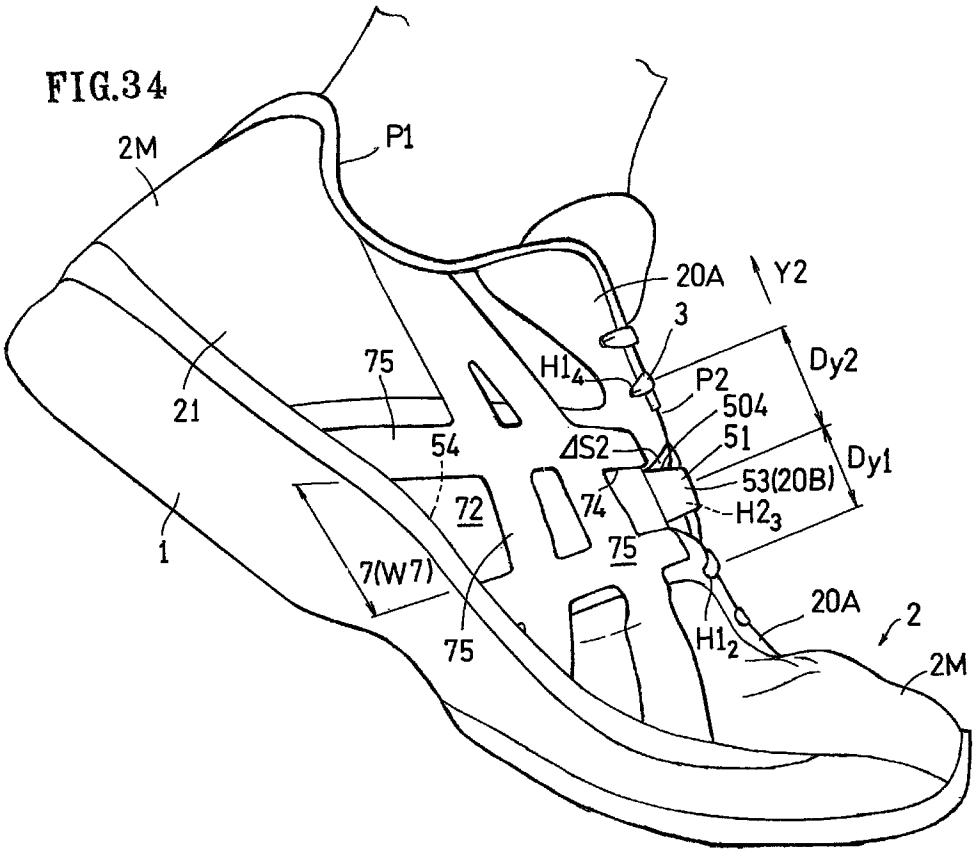
FIG. 34 is a schematic side view showing the shoe of the embodiment in a heel-raised position achieved by wearing the shoe and raising the heel.

By the dorsal flexion, the distance (Dy1+Dy2) between the first eyelets $H1_2$ and $H1_4$ of FIGS. 33 and 35 shortens as shown in FIGS. 34 and 36.

On the medial side of the foot of FIG. 34, the third distance Dy2 is shortened in response to the dorsal flexion of the MP joint, indicating that the first side panel 51 on the medial side of the foot deforms so as to pivot about the bottom portion 54 as the center toward the rear edge 74 of the division portion 7. Thus, it can be seen that the second eyelets $H2_3$ are relatively displaced in the rear direction Y2 of the diagonal front-back direction with respect to the first eyelets $H1_4$ on the rear side. That is, as the angle θ of FIG. 39A increases, the second eyelets $H2_3$ of FIG. 30 are displaced in the upward direction Z1 (the circumference direction) with respect to the first eyelets $H1_4$.

On the other hand, it can be seen that on the lateral side of the foot of FIG. 35, as the MP joint is dorsally flexed, the main upper 2M anterior to the division portion 7 (front foot portion) is significantly distorted in the vicinity of the hypothenar of the foot, shortening the second distance Dy1. Therefore, it can be seen that the front edge 73 of the division portion 7 comes closer to the front edge 503 of the second side panel 52 on the lateral side of the foot, and therefore the second eyelet $H2_3$ is relatively displaced in the front direction Y1 of the diagonal front-back direction with respect to the first eyelet $H1_2$ on the front side.

It is presumed that the reason why the deformation of the division portion 7 and the main upper 2M on the medial side of the foot is different from that on the lateral side of the foot is that the deformation of the foot during dorsal flexion on the medial side is different from that on the lateral side. It is also presumed that the distance $D_3$ between the second eyelets $H2_3$ and $H2_3$ of FIG. 29 became slightly longer as the instep bulges in a diagonally forward and upward direction during dorsal flexion.

Figure 41A:
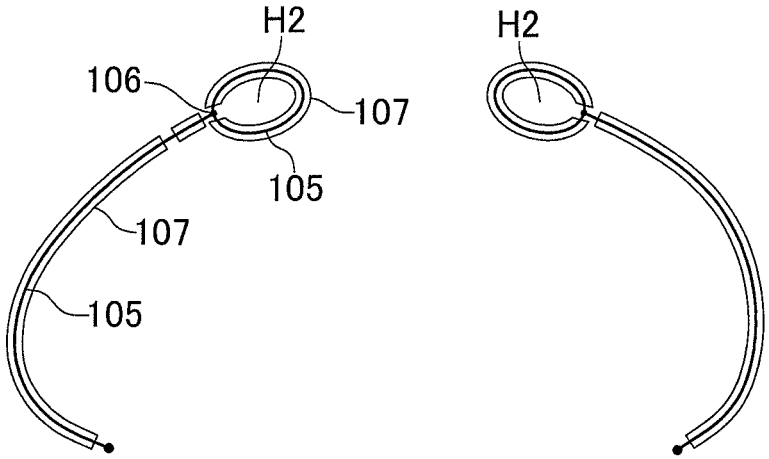
FIGS. 41A and 41B are a conceptual front view and a conceptual plan view, respectively, showing the structure of the second eyelets according to a sixth embodiment.
Figure 41B:
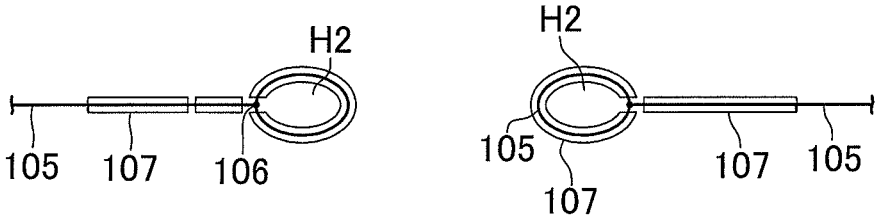

Next, a sixth embodiment will be described with reference to FIGS. 41A and 41B.

As shown in these figures, the second eyelet H2 may be formed by a loop with a hinge 106 provided at the tip of a stretchable member 105 such as a fishing line. The stretchable member 105 is inserted through a tube 107.

While preferred embodiments have been described above with reference to the drawings, various obvious changes and modifications will readily occur to those skilled in the art upon reading the present specification.

For example, the side panel may be provided along the outer surface of the main upper. The stretchable portion of the side panel may be provided only on one of the medial side surface and the lateral side surface of the foot.

A pair of side panels may be provided, with the stretchable portion provided only in one of the pair of side panels, and the positions of the side panels may be arranged while being staggered from each other in the front-back direction (diagonally opposing each other).

A pair of side panels with no stretchable portion may be provided, with stretchable portions provided in portions of the upper other than the side panels. In such a case, not only do second eyelets provided with stretchable portions move, but also first eyelets provided in the side panels move in the diagonal front-back direction.

The first portion may be formed by a material having rubber elasticity, and in such a case it may be provided in a linear pattern in the front-back direction. It is not always necessary to provide the first portion.

Thus, such changes and modifications are deemed to fall within the scope of the present invention, which is defined by the appended claims.

INDUSTRIAL APPLICABILITY

The present invention is applicable to a shoe having a shoelace for fitting an upper of the shoe to the foot.

DESCRIPTION OF THE REFERENCE NUMERALS

1: Sole
2: Upper
2M: Main upper (main portion)
2*t*: Tape material
20: First side edge portion
20A: First side edge portion
20B: Second side edge portion
21: Medial side surface
22: Lateral side surface
23: Front surface material
24: Back surface material
25: Notch
29: Housing
3: Shoelace
33,34: V-shaped portion
4: Tongue
5: Stretchable portion (movable portion)
5A: Stretchable portion (movable portion)
5B: Stretchable portion (movable portion)
50: First portion
50*a*: Reinforcement material
59: Second portion
51: First side panel (movable portion)
52: Second side panel (movable portion)
53: Tip portion (of side panel) (second side edge portion)
53*a*: Eyelet member
53*b*: Eyelet member
54: Bottom portion (of side panel)
55: Middle portion (of side panel)
55*h*: Through holes
501: Inner surface (of side panel)
502: Outer surface (of side panel)
503: Front edge (of side panel)
504: Rear edge (of side panel)
7: Division portion
71: Inner skin
72: Outer skin
73: Front edge
74: Rear edge
75: Tape material
711: Inner surface (of inner skin)
712: Outer surface (of inner skin)
721: Inner surface (of outer skin)
722: Outer surface (of outer skin)
B: Back surface
$B4_1$: Metatarsal bone of first toe
$B4_4$h: Head of (metatarsal bone of first toe)
$B4_1$b: Base of (metatarsal bone of first toe)
$B4_4$: Metatarsal bone of fourth toe
$B4_4$h: Head of (metatarsal bone of fourth toe)
$B4_4$b: Base of (metatarsal bone of fourth toe)
Dy: First distance
Dy1: Second distance Dy2: Third distance
f1: First toe
f4: Fourth toe
f5: Fifth toe
FW: Resultant force
FW1: First tensile force
FW2: Second tensile force
H1: First eyelet
H2: Second eyelet
IN: Medial side direction
Is: Instep
OUT: Lateral side direction
P1: First opening (of upper)
P2: Second opening (of upper)
Le: Leg
LJ: Lisfranc joint
MP: MP joint
R: Circumference direction
S1: Medial side surface (of foot)
S2: Lateral side surface (of foot)
T: Toe
W5: Width of side panel
W7: Width of division portion
W51: Tip
W52: Bottom
X: Transverse direction
Y: Diagonal front-back direction
Y1: Front side
Y2: Rear side
Z1: Upper side
Z2: Lower side
ΔS1: Front gap
ΔS2: Rear gap
θ: Angle

The invention claimed is:

1. A shoe having a lace fitting structure, comprising:

a sole for absorbing an impact of landing, an upper for wrapping around an instep, and a shoelace means for fitting the upper to the instep, wherein the upper includes a first opening from which a leg extends upward when the shoe is worn, and a second opening provided on a front side of the first opening, the two openings being continuous with each other in a front-back direction, the upper comprising:

a first side edge portion provided along a side edge of the second opening and having a plurality of first eyelets which the shoelace means passes through and engages with;

a second side edge portion arranged between the plurality of first eyelets and having one or more second eyelets which the shoelace means passes through and engages with;

a movable portion for allowing the one or more second eyelets to move with respect to the first eyelets in a transverse direction across the second opening and a diagonal front-back direction that is perpendicular to the transverse direction and is extending along the instep; and a main portion covering a medial side surface, a lateral side surface, a toe, the instep, and a back surface of a foot, the main portion including the first side edge portion and excluding the second side edge portion and the movable portion, wherein the second side edge portion including the one or more second eyelets is relatively displaced via the movable portion with respect to the main portion in the transverse direction and the diagonal front-back direction in response to a change in a direction of a resultant force between a first tensile force and a second tensile force acting upon the second side edge portion from a V-shaped portion of the shoelace means engaging with the one or more second eyelets while transitioning from a flat-footed position to a heel-raised position.

2. A shoe according to claim 1, wherein one of the first eyelets is adjacent to the one or more second eyelets on a front side thereof in the diagonal front-back direction, and another one of the first eyelets is adjacent to the one or more second eyelets on a rear side thereof in the diagonal front-back direction.

3. A shoe according to claim 2, wherein:

the plurality of first eyelets include first eyelets adjacent to each other in the diagonal front-back direction;

a second distance between one of the second eyelets and one of the first eyelets on a front side thereof is greater than a first distance between the first eyelets adjacent to each other in the diagonal front-back direction; and a third distance between one of the second eyelets and one of the first eyelets on a rear side thereof is greater than the first distance.

4. A shoe according to claim 1, further comprising a side panel extending in a diagonally rearward and downward direction from the second opening along a medial side surface or a lateral side surface of the foot in a space inside or outside the main portion so as to cover the medial side surface or the lateral side surface of the foot, wherein:

the side panel includes one of the second eyelets and the movable portion;

the first side edge portion including the first eyelets formed therein is divided into pieces, one on a front side and the other on a rear side of the side panel, thus forming a division portion in the main portion; and the side panel is arranged in the division portion.

5. A shoe according to claim 4, wherein a front gap is provided between a front edge of the division portion and a front edge of the side panel, the front gap allowing the side panel, which extends in the diagonally rearward and downward direction, to come relatively closer to the front edge of the division portion, whereby one of the second eyelets provided in the side panel is relatively movable, with respect to the first eyelets, toward a front side in the diagonal front-back direction and in the transverse direction.

6. A shoe according to claim 4, wherein a rear gap is provided between a rear edge of the division portion and a rear edge of the side panel, the rear gap allowing the side panel, which extends in the diagonally rearward and downward direction, to come relatively closer to the rear edge of the division portion, whereby one of the second eyelets provided in the side panel is relatively movable, with respect to the first eyelets, toward a rear side in the diagonal front-back direction and in the transverse direction.

7. A shoe according to claim 4, wherein:

the division portion is formed by a sheet-like member that has a flexural rigidity smaller than a flexural rigidity of the main portion on a front side and a rear side of the division portion, or shrinks more easily than the main portion; and a flexural rigidity of a member forming the side panel is greater than the flexural rigidity of the sheet-like member of the division portion.

8. A shoe according to claim 7, wherein:

the division portion is formed in a pocket-like shape having an inner skin and an outer skin; and the inner skin and the outer skin are apart from each other in the transverse direction at a front edge and a rear edge of the division portion.

9. A shoe according to claim 8, wherein the sheet-like member of the division portion is thinner than a member forming the main portion on the front side and the rear side of the division portion.

10. A shoe according to claim 4, wherein the one or more second eyelets are provided at positions between a head and a base of a first metatarsal bone on a medial side of the foot without being provided in an area posterior to the base of the metatarsal bone and an area anterior to the head of the metatarsal bone on the medial side of the foot.

11. A shoe according to claim 4, wherein:

the division portion is formed in a pocket-like shape having an inner skin and an outer skin; and the inner skin is in contact with an inner surface of the side panel, and an inner surface of the inner skin is smoother than an inner surface of the main portion.

12. A shoe according to claim 4, wherein:

the division portion is formed in a pocket-like shape having an inner skin and an outer skin; and an outer surface of the inner skin and an inner surface of the outer skin, which are in contact with a surface of the side panel, are smoother than an outer surface of the main portion.

13. A shoe according to claim 4, wherein:

the division portion is formed in a pocket-like shape having an inner skin and an outer skin;

the division portion extends from an upper surface of the sole to the second opening in a diagonal direction, which slopes up in a front direction; and the inner skin and the outer skin are formed by a woven fabric, a knit fabric or a meshed sheet-like material capable of stretching in the diagonal direction.

14. A shoe according to claim 4, wherein:

the side panel includes a bottom portion fixed to the sole, a tip portion which forms the second side edge portion, and a middle portion which connects between the bottom portion and the second side edge portion and forms the movable portion; and the middle portion and second side edge portion are connected to the sole only via the bottom portion.

15. A shoe having a lace fitting structure, comprising:

a sole for absorbing an impact of landing, an upper for wrapping around an instep, and a shoelace means for fitting the upper to the instep, wherein the upper includes a first opening from which a leg extends upward when the shoe is worn, and a second opening provided on a front side of the first opening, the two openings being continuous with each other in a front-back direction, the upper comprising:

a side edge portion provided along a side edge of the second opening and having a plurality of first eyelets which the shoelace means passes through and engages with;

a side panel extending downward or diagonally downward from the second opening along a medial side surface or a lateral side surface of the foot so as to cover the medial side surface or the lateral side surface of the foot; and a main portion covering the medial side surface, the lateral side surface, a toe, the instep, and a back surface of the foot, the main portion including the side edge portion and excluding the side panel, the side panel comprising:

a tip portion having a second eyelet which is provided at a tip of the side panel and which the shoelace means passes through and engages with, the tip portion being unattached to the main portion;

a bottom portion attached to the main portion and/or the sole; and a middle portion arranged between the tip portion and the bottom portion, wherein:

the tip portion of the side panel is capable of relatively moving with respect to the main portion in a diagonal front-back direction that is perpendicular to a transverse direction across the second opening and is extending along the instep;

the side panel is arranged in a division portion obtained by dividing the side edge portion including the first eyelets formed therein into pieces, one on a front side and the other on a rear side;

a width of the side panel in the diagonal front-back direction is smaller than that of the division portion;

a sheet-like member forming the division portion has a flexural rigidity smaller than a flexural rigidity of a member forming the main portion on a front side and a rear side of the division portion, or shrinks more easily than the member forming the main portion; and a flexural rigidity of a member forming the side panel is greater than the flexural rigidity of the sheet-like member of the division portion.

16. A shoe according to claim 15, wherein the sheet-like member of the division portion is thinner than the member forming the main portion on the front side and the rear side of the division portion.

17. A shoe according to claim 15, wherein the one or more second eyelets are provided at positions between a head and a base of a first metatarsal bone on a medial side of the foot without being provided in an area posterior to the base of the metatarsal bone and an area anterior to the head of the metatarsal bone on the medial side of the foot.

18. A shoe according to claim 15, wherein:

the division portion is formed in a pocket-like shape having an inner skin and an outer skin; and the inner skin is in contact with an inner surface of the side panel, and an inner surface of the inner skin is smoother than an inner surface of the main portion.

19. A shoe according to claim 15, wherein the division portion is formed in a pocket-like shape having an inner skin and an outer skin; and an outer surface of the inner skin and an inner surface of the outer skin, which are in contact with surfaces of the side panel, are smoother than an outer surface of the main portion.

20. A shoe according to claim 15, wherein:

the division portion is formed in a pocket-like shape having an inner skin and an outer skin; and the division portion extends from an upper surface of the sole to the second opening in a diagonal direction, which slopes up in a front direction; and the inner skin and the outer skin are formed by a woven fabric, a knit fabric or a meshed sheet-like material capable of stretching in the diagonal direction.

21. A shoe according to claim 15, wherein the bottom portion of the side panel is fixed to the sole, and the middle portion and the tip portion are connected to the sole only via the bottom portion.

22. A shoe according to claim 21, wherein a front gap is provided between a front edge of the division portion and a front edge of the side panel, the front gap allowing the side panel, which extends in a diagonally front direction from the sole toward the second opening, to come relatively closer to the front edge of the division portion, whereby one of the second eyelets provided in the side panel is relatively movable, with respect to the first eyelets, toward a front side in the diagonal front-back direction.

23. A shoe according to claim 21, wherein a rear gap is provided between a rear edge of the division portion and a rear edge of the side panel, the rear gap allowing the side panel, which extends in a diagonally front direction from the sole toward the second opening, to come relatively closer to the rear edge of the division portion, whereby one of the second eyelets provided in the side panel is relatively movable, with respect to the first eyelets, toward a rear side in the diagonal front-back direction.

* * * * *